US005624231A

United States Patent [19]

Ohtomo et al.

[11] Patent Number: 5,624,231

[45] Date of Patent: Apr. 29, 1997

[54] COOLED TURBINE BLADE FOR A GAS TURBINE

[75] Inventors: Fumio Ohtomo, Zama; Yoshitaka Fukuyama, Yokohama; Yuji Nakata, Yokohama; Asako Inomata, Yokohama; Hisashi Matsuda, Yokohama; Shoko Ito, Yokohama, all of Japan

[73] Assignee: Kabushiki Kaisha Toshiba, Kawasaki, Japan

[21] Appl. No.: 364,686

[22] Filed: Dec. 28, 1994

[30] Foreign Application Priority Data

Dec. 28, 1993 [JP] Japan ..... 5-335454

[51] Int. Cl.[6] ..... F01D 5/18

[52] U.S. Cl. ..... 416/97 R; 415/115

[58] Field of Search ..... 416/96 A, 97 R; 415/115

[56] References Cited

U.S. PATENT DOCUMENTS

| | | | |
|---|---|---|---|
| 4,118,146 | 10/1978 | Dierberger | 415/115 X |
| 4,676,719 | 6/1987 | Auxier et al. | 415/115 |
| 4,767,261 | 8/1988 | Godfrey et al. | 415/115 |
| 5,120,192 | 6/1992 | Ohtomo et al. | 415/115 |
| 5,374,162 | 12/1994 | Green | 415/115 |
| 5,392,515 | 2/1995 | Auxier et al. | 416/97 R |
| 5,417,545 | 5/1995 | Harrogate | 415/115 |
| 5,419,681 | 5/1995 | Lee | 415/115 |

FOREIGN PATENT DOCUMENTS

| | | |
|---|---|---|
| 58-117302 | 7/1983 | Japan . |
| 61-4001 | 2/1984 | Japan . |
| 62-258103 | 11/1987 | Japan . |

*Primary Examiner*—Edward K. Look

*Attorney, Agent, or Firm*—Oblon, Spivak, McClelland, Maier & Neustadt, P.C.

[57] ABSTRACT

A turbine blade performs internal cooling by a cooling gas flowing through internal cooling flow passages and FCFC cooling by a cooling gas jetted out through film holes arranged on the substantially whole area of the blade surface. The film holes are arranged in rows extending in the span direction at predetermined pitches in the chord direction. The dimensions of the elements of the turbine blade are determined by a mathematical formula $5 \leqq L/N \cdot D \leqq 50$, where L is the length of any interval of the surface of the cooled turbine blade, N is the number of rows of the film holes in the interval and D is an average diameter of the film holes in the interval. With this arrangement, the maximum cooling efficiency at a small amount of cooling gas flow is attained, and both the quantity of heat per unit area of the blade surface transmitted from the main flow gas to the blade surface and the thermal stresses are reduced.

6 Claims, 16 Drawing Sheets

COOLED TURBINE BLADE FOR A GAS TURBINE

BACKGROUND OF THE INVENTION

1. Field of the Invention

The present invention relates to a cooled turbine blade for a gas turbine, and more particularly to a full coveraged film cooling (FCFC) type turbine blade provided with film holes over the whole surface of the turbine blade.

2. Description of the Related Art

There are various types of gas turbines, and one of them is of a direct driving type for operating a compressor by means of a turbine driven by a burnt gas flow. In such a gas turbine, the higher the temperature of the burnt gas, i.e., the main flow gas is, the more the heat efficiency of the gas turbine is improved. Attempts have been made to increase the temperature of the main flow gas for this purpose. In general, however, the upper temperature of the main flow gas is limited by heat resistance of the turbine blade. In order to improve the heat resistance of the turbine blade, the turbine blade must withstand a high temperature. For the improvement of the heat resistance of the turbine blade, the heat resistance of the material of the turbine blade has been improved and the turbine blade has been cooled from its inside to lower its surface temperature. Such a turbine blade is provided in its interior with cooling flow passages through which a cooling gas such as water vapor or air passes and also provided with various other means for improving cooling efficiency. A cooling gas such as air is jetted out of a plurality of film holes formed in the blade surface. The blade surface is covered with a thin layer of the cooling gas, i.e., a film and cooled. The turbine blade is further provided with means for insulating heat from the main flow gas.

FIGS. 31 and 32 show a conventional cooled turbine blade of this type. FIG. 31 is a transverse cross-sectional view of the turbine blade and FIG. 32 is a longitudinal cross-sectional view thereof. The turbine blade 1 has an aerofoil blade portion 2 in which are formed a plurality of serially communicating cooling flow passages 4, 10, 12 and 13 extending in the span direction. The cooling gas flows through the cooling flow passages 12, 10 and 13 via passages formed in a shank 3 and cools wall portions 6 and 7 of the turbine blade. A plurality of nozzles 8 and 17 are formed in the wall portions 6 and 7. Part of the cooling gas flowing through the cooling flow passages 4 and 13 is jetted from the nozzles 8 and 17. The jetted cooling gas flows in a film state along the suction side surface and the pressure side surface of the aerofoil blade portion 2 so as to interrupt the heat transmitted to the surface of the aerofoil blade portion 2 and so as to cool the surface of the aerofoil blade portion 2. In this way, so-called film cooling is performed.

An impingement chamber is formed in the leading edge portion of the turbine blade 1. The cooling gas supplied to the cooling flow passage 4 is jetted out of a great number of holes and impinges on the inner surface of the wall 5 of the leading edge so as to perform so-called impingement cooling. In the wall 5 of the leading edge is formed a great number of nozzles so as to form a so-called shower head 9 from which the cooling gas in the impingement chamber or the leading edge chamber is jetted out to perform film cooling.

A trailing edge chamber is formed in the trailing edge portion 15 of the turbine blade 1. The cooling gas flows from the cooling flow passage 13 into the trailing edge chamber through a nozzle 14. In the trailing edge of the turbine blade 1 is formed a slit-like trailing edge nozzle 16 through which the cooling gas is exhausted from the trailing edge chamber to the outside thereof. A great number of pin fins 11 are formed in the trailing edge chamber and improves the cooling efficiency of the trailing edge portion 15.

In FIG. 33 is shown an insert impingement film type cooled turbine blade applied to the stator blade of a gas turbine. The cooled turbine blade 21 has a blade body 22 in which inserts 23*a* and 23*b* are inserted. The inner surface of the blade body is impinge cooled by a cooling gas 24 jetted from the inserts 23*a* and 23*b*. In the blade surface awe formed rows of film holes 25. The cooling gas jetted out of the cooling holes 25 film cools the turbine blade so that the turbine blade of the temperature is maintained to a predetermined value and thermal stresses produced in the turbine blade is reduced.

The interior of the inserts 23*a* and 23*b* are not partitioned, and the amount of flow of the cooling gas flowing in the turbine blade is suitably adjusted by a plurality of seal members disposed between the outer surface of the inserts and the blade body 22.

Since the thickness of the area of the turbine blade from its trailing edge portion 27 to its trailing edge 28 is small, this area does not have an enough room to receive such inserts. In place thereof, rows of pin fins 29 and a plurality of projecting turbulence promoters 30 are formed on the inner surfaces of the trailing edge portions 28. The cooling gas flows through the interior of the trailing edge 28 and is exhausted from openings 31 in the trailing edge 28.

In the turbine provided with the above-mentioned cooled turbine blade, an average surface temperature of the turbine blade of 850° C. can be maintained when the temperature of the main flow is in the range between 1,000° C. and 1,300° C. and the amount of the cooling gas is several percent of the amount of the main flow gas. Recently, however, gas turbines operating at the temperature of the main flow gas from 1,300° C. to 1,500° C. have been developed, and further, development of gas turbines operating at the temperature of the main flow gas between 1,500° C. and 2,000° C. is now planned.

In the cooled turbine blade of the conventional gas turbine, the amount of the cooling gas must be extremely large in order to maintain the average surface temperature of 850° C. The total heat efficiency of a gas turbine or the heat plant including this gas turbine is remarkably reduced and its actualization is very difficult.

In order to manufacture a practical gas turbine operating at a high temperature, the turbine blade must be designed so that a maximum cooling efficiency must be attained under the limited condition of the amount of the cooling gas as described above. When, however, the temperature of the main flow gas is extremely high, another new problem occurs in which the quantity of heat per unit area of the blade surface which flows on the blade surface increases. The quantity of heat transmitted through the material of the turbine blade per unit area increases and large thermal stresses are produced in the material.

The problem on production of the thermal stresses cannot be overcome even if the cooling efficiency achieved by improvement of the cooling gas is enhanced. If the surface of the temperature of the turbine blade is lowered by increasing the cooling efficiency due to the cooling gas conducted through the interior of the turbine blade, the difference between the surface temperature of the turbine blade and the temperature of the main flow gas, and the quantity of heat per unit area flowing on the blade surface adversely increases to elevate the thermal stresses. Increase of the quantity of heat per unit area and the accompanying thermal stresses shortens the life of the turbine blade. In a particular case of an electric power plant including gas turbines, they must be operated for a long rated time. Thus, the heat quantity per unit area and the accompanying thermal stresses cannot be increased.

In order to overcome such deficiencies, it is preferred that the film cooling effect of the blade surface be enhanced and the heat quantity per unit area flowing on the blade surface be reduced. By film cooling performed by a thin gas layer, i.e., a film flowing along the blade surface, the blade surface is cooled and the quantity of heat transmitted to the blade surface is reduced. Thus, the quantity of heat per unit area flowing on the blade surface is lowered. The cooling effect is increased in such a way that an FCFC turbine blade (a full coveraged film cooling type turbine blade) is used by increasing the number of the film holes.

The amount of the cooling gas required for film cooling the FCFC turbine blade becomes more than that of the conventional cooled turbine blade, and the total heat efficiency of the heat plant including a gas turbine is reduced.

SUMMARY OF THE INVENTION

The present invention was made under the above-mentioned circumstances and the object thereof is to provide an FCFC turbine blade in which the flow amount of a used cooling medium such as a cooling gas can be made as small as possible and thermal stresses can be reduced.

In order to achieve the object, a turbine blade according to the present invention has a plurality of rows of film holes arranged in the chord direction of the turbine blade. The whole surface of the turbine blade is FCFC cooled by a cooling gas jetted out of the film holes. In the turbine blade of the present invention are formed cooling flow passages through which a cooling gas flows and cools the turbine blade from its inside. The turbine blade is cooled by the cooling gas not only by the FCFC cooling process but also by a cooling process from the inside of the turbine blade.

The present invention is characterized in that the diameter of each film cooling hole, the number of rows of the film holes and the peripheral length of the turbine blade in the chord direction is set to have such a predetermined relationship that, when D is the average diameter of the film holes, N is the number of the rows of the film holes and L is the peripheral length of the turbine blade in the chord direction, $$5 \leqq R \leqq 50$$

where $R=L/N \cdot D$. R is a value of the density of the openings of the film holes in the chord direction of the turbine blade.

According to the present invention, the amount of the cooling gas flow is small, the cooling efficiency is the maximum, the surface temperature of the turbine blade is limited to the allowed range and the thermal stresses are lowered.

When the value of R exceeds 50, the effect of the film cooling becomes insufficient, and the quantity of heat per unit area transmitted from the main gas flow to the blade surface becomes large. If, therefore, the cooling effect of the cooling gas flowing through the cooling flow passages in the turbine blade is increased by improving the cooling passage in the turbine blade, the problem on the thermal stresses cannot be overcome, because it is considered that the film cooling effects due to the cooling gas jetted out of the adjacent rows of film holes are added to each other. When, on the other hand, the value of R is less than 5, the increase of the film cooling efficiency is saturated. In the range of R less than 5, the number of the film holes is large, and the passages of the cooling gas in the turbine blade become complicated. Thus, there is no merit. In this connection, FCFC cooling can perform efficiently in the range of R between 5 to 50.

The turbine blade of the present invention is cooled from its inside by the cooling gas flowing through the turbine blade in accordance with the suitable FCFC cooling process. The cooling efficiency depends on the structure of the cooling flow passages, and various means are provided on the cooling flow passages to achieve a high cooling efficiency.

In an embodiment according to the present invention, the turbine blade has a hollow structure surrounded by an outer wall. The interior of the hollow blade is divided by a great number of partition walls into cooling flow passages. The total thermal exchange area of the partition walls facing the cooling flow passages is set to 1.5 times or more than the area of the inner surface of the outer wall of the turbine blade. The turbine blade can be sufficiently cooled from the inside by the cooling gas flowing through the cooling flow passages. In this embodiment, the internal structure of the turbine blade is simple. The turbine blade is manufactured easily and has a high mechanical strength.

In another embodiment, the thickness of the outer wall of a turbine blade is relatively thick. A great number of main cooling flow passages each having a relatively small cross-sectional area are formed in the vicinity of the outer surface of the outer wall. A cooling gas flows through the main cooling flow passages. Secondary cooling flow passages are formed between the adjacent main cooling flow passages. A small amount of the cooling gas passes through the secondary cooling flow passages or an amount of the cooling gas stays in them. Thermal stresses generated between the main cooling flow passages are reduced by the cavity-shaped secondary cooling flow passages.

In a further embodiment according to the present invention, a turbine blade is formed hollow by surrounded by outer wall. Hollow inserts are inserted in the turbine blade, and a space is formed between the outer surfaces of the inserts and the inner surface of the outer wall of the blade. On the inner wall of the outer wall are formed a plurality of projecting walls by which the space between the outer surfaces of the inserts and the inner surface of the outer wall is divided into a plurality of partition chambers. A plurality of impingement holes corresponding to the partition chambers are formed in the inserts. A cooling gas is jetted out of the impingement holes toward the outer wall or the projecting walls to perform impingement cooling. A plurality of film holes corresponding to the partition chambers in the outer wall and the partition chambers communicate with each other.

In this embodiment, the outer wall of the turbine blade can be cooled at high cooling efficiency due to impingement cooling. Since the space formed between the outer peripheral surfaces of the inserts and the inner peripheral surfaces of the outer wall is divided into a plurality of partition chambers and the partition chambers are caused to communicate with each other by means of the film holes, the cooling gas jetted out of the impingement holes of the inserts collides on the outer wall or the projecting walls. Then, after flowing along the wall surfaces by a short distance, the cooling gas is exhausted from the film holes immediately. Thus, cross flow, i.e., interference of the cooling gas flowing along the wall surfaces with the cooling gas jetted out of the impingement holes is reduced and the cooling efficiency is improved more.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

The preferred embodiments of the present invention will be described with reference to the accompanying drawings.

Figure 1:
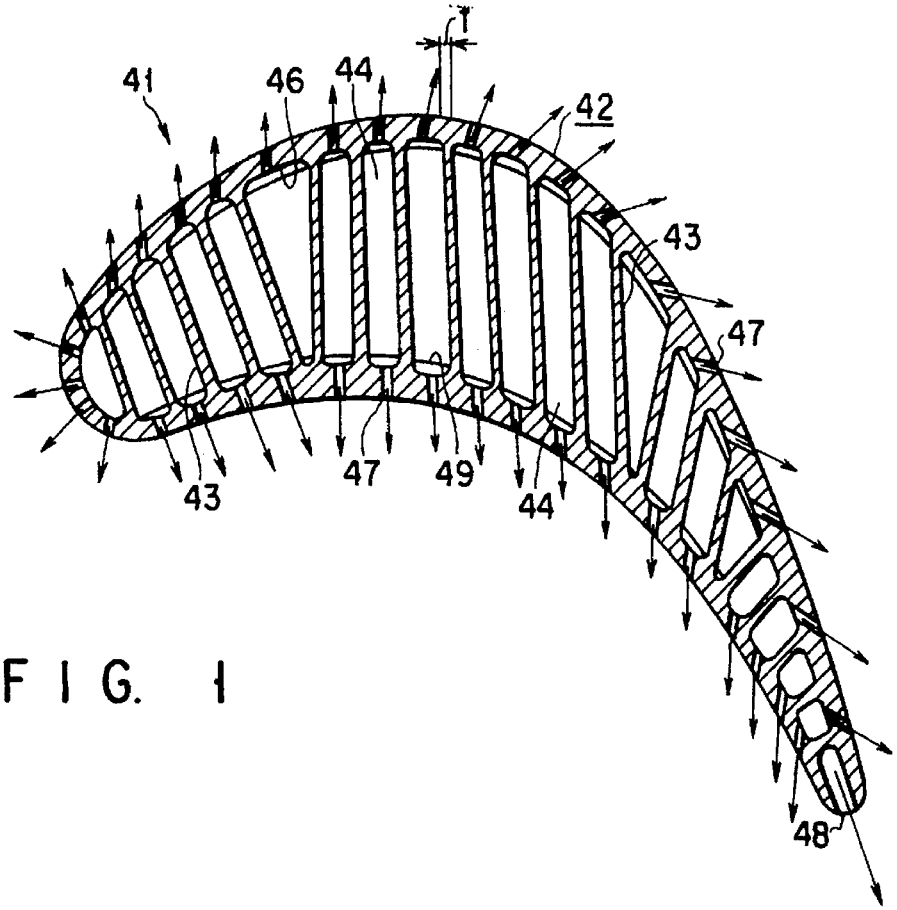
FIG. 1 is a transverse cross-sectional view of a cooled turbine blade according to a first embodiment of the present invention.
Figure 2:
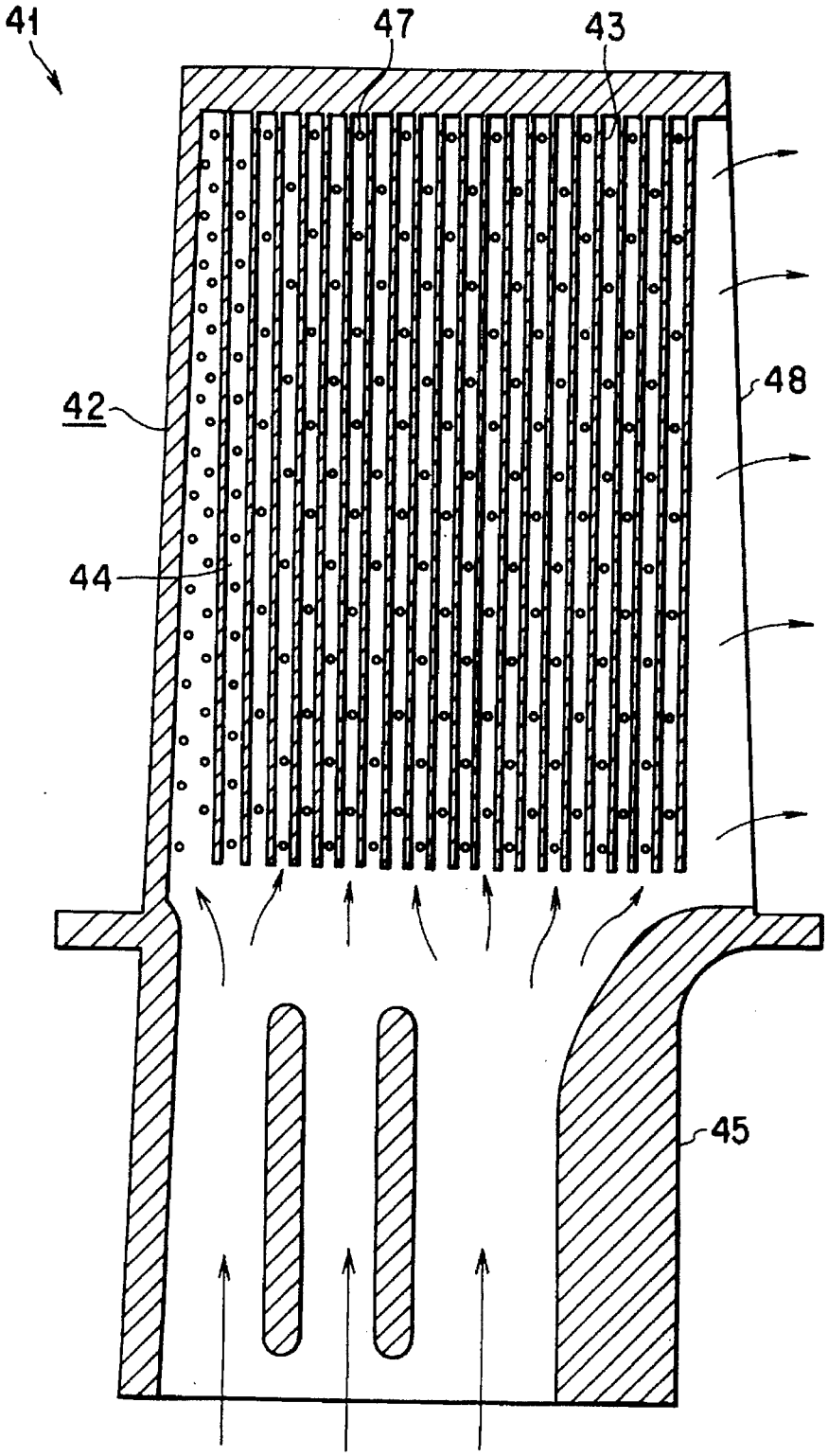
FIG. 2 is a longitudinal cross-sectional view of the cooled turbine blade according to the first invention.
Figure 3A:
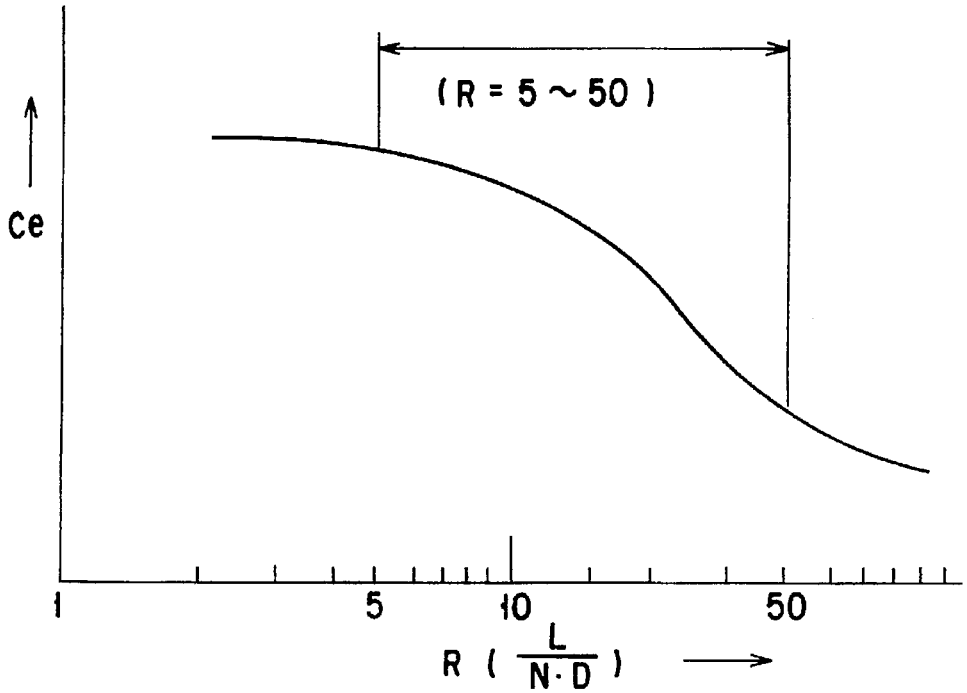
FIG. 3A is a graph showing a relation between the opening density of film holes and the cooling efficiency when FCFC cooling is performed.
Figure 3B:
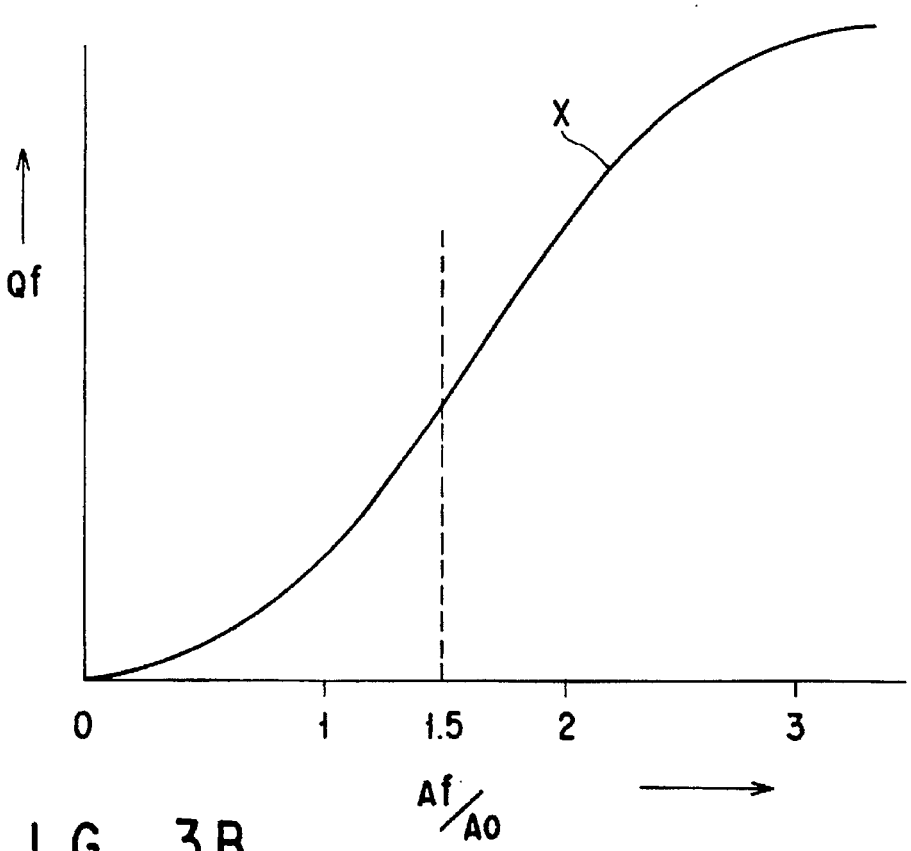
FIG. 3B is a graph showing the characteristic of transmitted amount of heat at the ratios of the total heat transmission area of the partition walls to the total heat transmission area of the inner surface of the turbine blade of the first embodiment.

A first embodiment of the present invention is shown in FIGS. 1 to 3B. The features of the present invention which will be described by way of the first embodiment with reference to FIG. 1 are similarly applied to the other embodiments. FIG. 1 is a transverse cross-sectional view of the turbine blade of a turbine rotor of the first embodiment and FIG. 2 is a longitudinal cross-sectional view thereof. FIG. 3A is a graph showing a characteristic when FCFC cooling is performed, and FIG. 3B is a graph showing the relation of the heat transmission areas between partition walls and the outer wall of the turbine blade.

A turbine blade 41 has a hollow aerofoil portion 42 surrounded by outer wall 46. The interior of the hollow aerofoil portion 42 is divided into a plurality of cooling flow passages 44 by partition walls 43 which are integral with the turbine blade. A cooling gas is supplied from a cooling gas inlet formed in a shank 45 of the turbine blade 41 to the cooling flow passages 44.

In the outer wall 46 are formed a plurality of film holes 47 corresponding to the cooling flow passages 44. The film holes 47 pass through the outer wall 46, open outside of them at its outer surface and communicate with the cooling flow passages 44 and are arranged so as to form rows along the cooling flow passages 44, i.e., in the span direction. Thus, a plurality of rows of the film holes 47 are arranged in the chord direction.

The cooling gas supplied to the cooling flow passages flows through the cooling flow passages 44 in the span direction and cools the turbine blade from its inside. The cooling gas flows in contact with the inner surface of the outer wall 46 and the side surfaces of the partition walls 43 and convection cools the turbine blade. The cooling gas is jetted out of the cooling flow passages 44 through the film holes 47 and flows in a state in which the surface of the aerofoil portion 42 is covered with a film of the cooling gas. In this way, the surface of the outer wall 46 is cooled. At the same time, the main flow gas is prevented from contacting the surface of the outer wall 46 directly. Thus, heat is insulated to perform so-called film cooling.

Let it be assumed that L is the length of the interval of the outer surface of an outer wall 46 in the chord direction, N is the number of the rows of the film holes 47 arranged in the interval and D is the average diameter of the film holes 47, and that $$R=L/N\cdot D \quad (1)$$

Then, the dimension of each portion of the turbine blade is set so that R is expressed by the following formula:

$$5\leqq R\leqq 50 \quad (2)$$

where R is dimensionless figures and represents an opening density in the chord direction. By arranging the film holes 47 as described above, the turbine blade is cooled effectively and thermal stresses generated in the material of the turbine blade can be lowered as much as possible.

FIG. 3A shows a relation between R at a predetermined gas flow and cooling efficiencies Ce of film cooling. As apparent from the graph, the film cooling efficiency Ce becomes small when R is large, i.e., when the opening density of the film holes is small, but the film cooling efficiency Ce becomes large when R is large, i.e., when the opening density of the film holes is large. When the amount of the cooling gas flow is changed, the curve shown in FIG. 3A is merely shifted upward or downward and its characteristic changes little.

As R becomes smaller than 50, the film cooling efficiency decreases abruptly. In order to perform efficient film cooling by a limited amount of cooling gas flow, the diameters, the number of rows and the pitches of the film holes 47 are set so that R is equal to or less than 50. When, however, R is 5 or less than 5, the number of the film holes 47 increases, resulting in a complicated structure of the cooling flow passages in the blase. Thus, there is no merit. In this regard, film cooling is performed most efficiently by a limited amount of the cooling gas in the range of R from 5 to 50. Although the arrangement pitches of the rows of film holes 47 are limited in many cases in the actual design, the most effective FCFC cooling can be performed by a limited amount of the cooling gas flow by setting the diameters of the film holes 47 so that R is within this range.

The cooling flow passages 44 in the turbine blade are formed as mentioned above. The partition walls 43 function not only as partition walls but also substantially as cooling fins for increasing the transmission area for the cooling gas flowing through the cooling flow passages. The larger the ratio Af/Ao of the heat transmission area Af of the portion of each partition 43 which faces the corresponding cooling passage 44 to the heat transmission area Ao of the inner surface of the outer wall 46 of the turbine blade including the portion of the corresponding partition 43 at the thickness t, the more the amount of heat transmission Qf to the cooling gas increases. Af/Ao corresponds to the aspect ratio of the cross-sectional shape of each cooling flow passage 44.

The relation between Af/Ao and Qf is shown in FIG. 3B. It is apparent from this figure that, as apparent form this figure, as Af/Ao, i.e., the aspect ratio of the cooling flow passages becomes higher, the efficiency of heat transmission in the material of the partition walls 43 is reduced and the value of Af/Ao is saturated at about 3. It is also apparent from FIG. 3B that, when the value of Af/Ao is small, the amount of heat transmission Qf is also small, and the cooling efficient cannot be improved. When, on the other hand, the value of Af/Ao is 3 or more, the cooling efficiency is saturated and only the structure becomes complicated. Thus, there is no merit. From this characteristic, it is necessary to set the value of Af/Ao of the cooling flow passages 44 of such a structure to 1.5 or more.

In this structure, a row or a plurality of rows of film holes 47 are formed in a cooling flow passage 44, or a row of cooling holes 47 are formed in a plurality of cooling flow passages 44 so that the ratio of the number of the film holes 47 to the number of the cooling flow passages 44 is an integer. The pitch of the row of the film holes 47 must be selected so that Af/Ao is within the above mentioned range.

When a row of film holes 47 are formed in each of the cooling flow passages 44 in the turbine blades of the gas turbine of a heat plant such as an electric power plant, R can be set to a value within the above-mentioned most suitable range and the average value of Af/Ao is substantially 1.5 to 2.0. In this regard, the turbine blade of this embodiment has a simple structure and can be manufactured easily. The maximum FCFC cooling efficiency and the maximum internal cooling efficiency can be attained at the limited amount of the cooling gas flow, and the thermal stresses can be reduced. According the conditions of the turbine blade such as the dimension of the turbine blade, a plurality of rows of cooling flow passages are formed in each cooling tool or a row of film holes are formed in every two cooling flow passages so that R and Af/Ao are set to the values within the most suitable ranges.

As the interior of the cooled turbine blade 41 is divided by a great many partition walls 43, the rigidity of the turbine increases and the resistances against the thermal stresses and centrifugal forces during operation greatly increase. Thus, this turbine blade is applicable to a large turbine blade operating at a high temperature and at a high load.

Although not shown in the figure, one or more cooling gas outlets are formed in the communicating cooling flow passages 44 when the cooling flow passages in the leading edge portion and the trailing edge portion are bent in turn, whereby convection cooling is performed. Ribs 49 as heat transmission promoters crossing with the flow direction of the cooling medium are provided in the inner side walls 46 of the turbine blade and convection cooling is performed.

The turbine blade of this embodiment can be combined with a cooled turbine blade having another type of cooling elements to form a modification of the cooled turbine blade of this embodiment.

In a modification, partition walls extending along the center line of the turbine blade are provided for dividing the cooling flow passages 44 into suction side portions and pressure side portions so as to increase the convection flow effect in the turbine blade more.

In this embodiment, the turbine blade is described as a stator blade but may be a rotor blade in the similar way. The cooling medium may be not only air but also water vapor, an inert gas, a liquid or the like.

It follows that combination of the above-mentioned modifications can form various cooled turbine blades.

Figure 4:
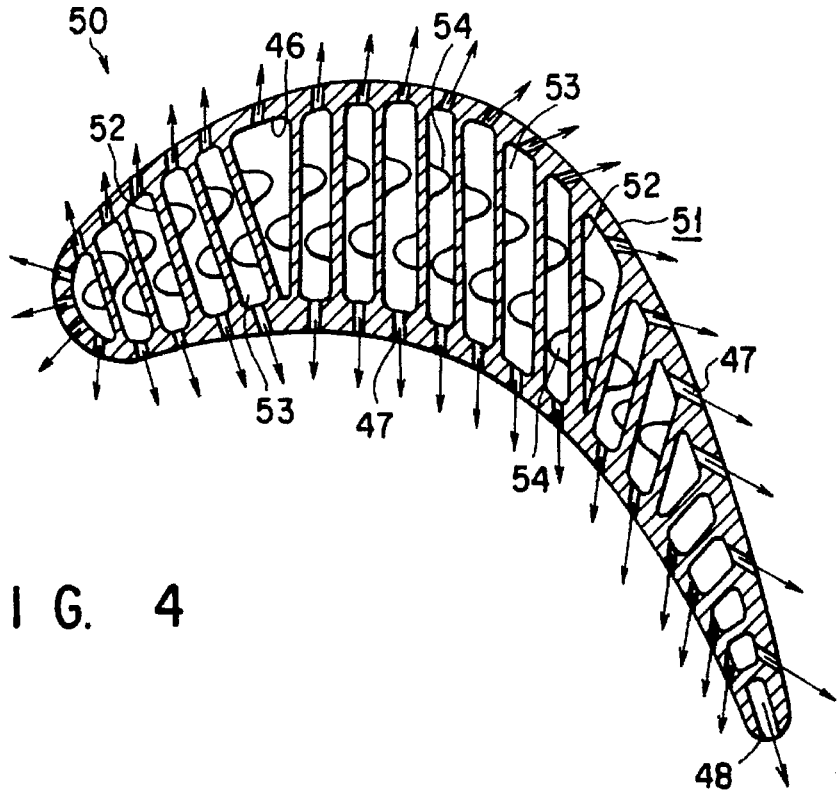
FIG. 4 is a transverse cross-sectional view of a second embodiment according to a cooled turbine blade of the present invention.

A second modification will be described with FIG. 4 which is a transverse cross-section thereof. In FIG. 4, the interior of a cooled turbine blade 50 is divided into a great number of cooling flow passages 53 by partition walls 52 extending in the span direction in an effective blade portions 51. A great numbers of projections 54 are formed on the partition walls 52 in the cooling flow passages 53 so as to coincide with the cooling medium jetted out of the film holes 47, and convection cooling is performed.

Similarly to the partition walls 43 of the first embodiment, the ratio of the total area of each partition 52 facing the corresponding cooling flow passage 53 to the total area of the inner surface of the outer wall 46 including the thickness of the portion fixed to the inner surface of the outer wall 46 is 1.5 or more.

This embodiment exhibits the similar function and effects to the first embodiment. The total heat transmission area of the partitions 52 is increased by the projections 54, and more effective convection cooling is performed.

Figure 5:
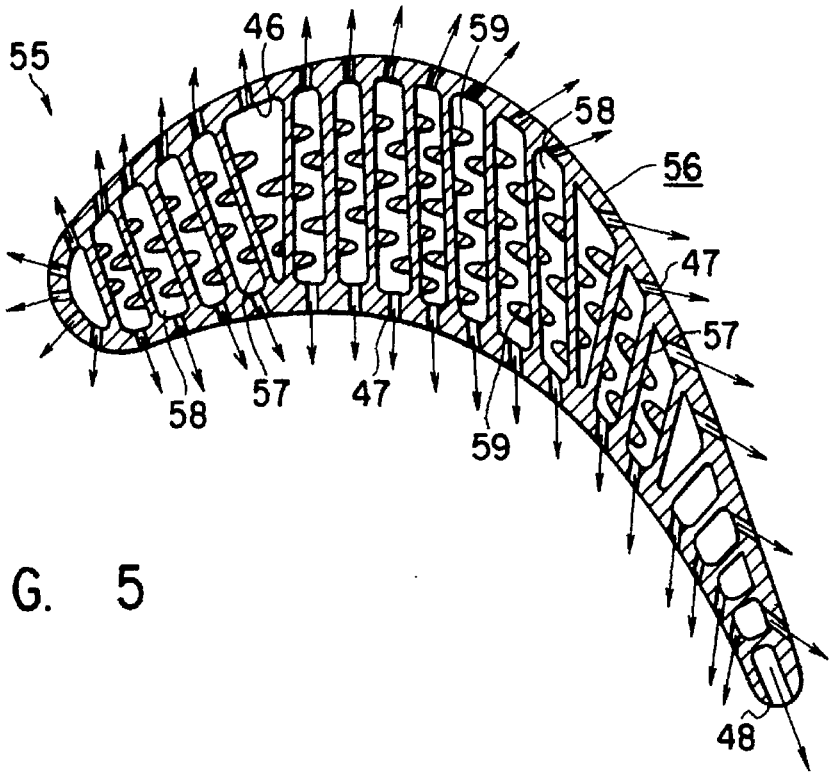
FIG. 5 is a transverse cross-sectional view of a third embodiment according to a cooled turbine blade of the present invention.

A third embodiment will be described with reference to FIG. 5 which is a transverse cross-sectional view thereof. As shown in FIG. 5, a cooled turbine blade 55 has an effective blade portion 56 whose interior is divided into a great number of cooling flow passages 58 by partition walls 57 extending in the span direction.

On the partition walls 57 are provided a great number of projections 59 extending in the span direction. Convection cooling is performed by the cooling medium supplied from the leading side edge and jetted out of the film holes 47.

Similar to the partition walls 57 of the first embodiment, the partition walls 57 of this embodiment is constructed so that the ratio of the total heat transmission area facing cooling flow passages 53 to the total heat transmission area of the inner surface of the outer wall 46 of the turbine blade including the thickness of the portions of the partition walls 57 fixed to the inner surface of the outer wall 46 is 1.5 or more.

This embodiment exhibits the similar function and effect to the first embodiment. The total heat transmission area of the partitions 57 is increased by the projections 59 to promote the convection cooling effectively.

Figure 6:
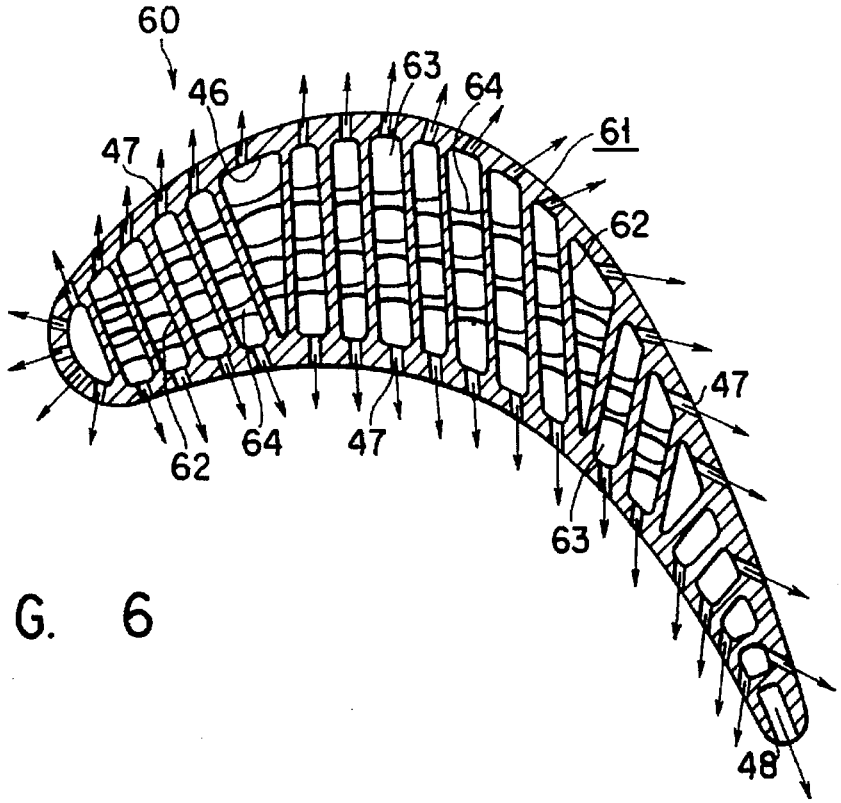
FIG. 6 is a transverse cross-sectional view of a fourth embodiment according to a cooled turbine blade of the present invention.

A fourth embodiment will be described with reference to FIG. 6 which is a transverse cross-section thereof. In FIG. 6, the interior of the effective blade portion 61 of a cooled turbine blade 60 is divided into a great number of cooling flow passage 63 by partition walls 62 extending in the span direction.

A great number of projecting pin fins 64 are formed on the partition walls 62 and are substantially perpendicular to the flow of the cooling medium. The cooling medium supplied from the leading edge portion side and jetted out of the film holes 47 performs convection cooling.

Similarly to the case of the first embodiment, the partition walls 62 are formed so that the ratio of the total heat transmission area facing cooling flow passages 63 to the total heat transmission area of the inner surface of the outer wall 46 of the turbine blade including the thickness of the portions of the partition walls 62 fixed to the inner surface of the outer wall 46 is 1.5 or more.

This embodiment exhibits the similar function and effect to the first embodiment. The total heat transmission area of the partitions 57 is increased by the projections 59 to promote the convection cooling effectively.

Figure 7:
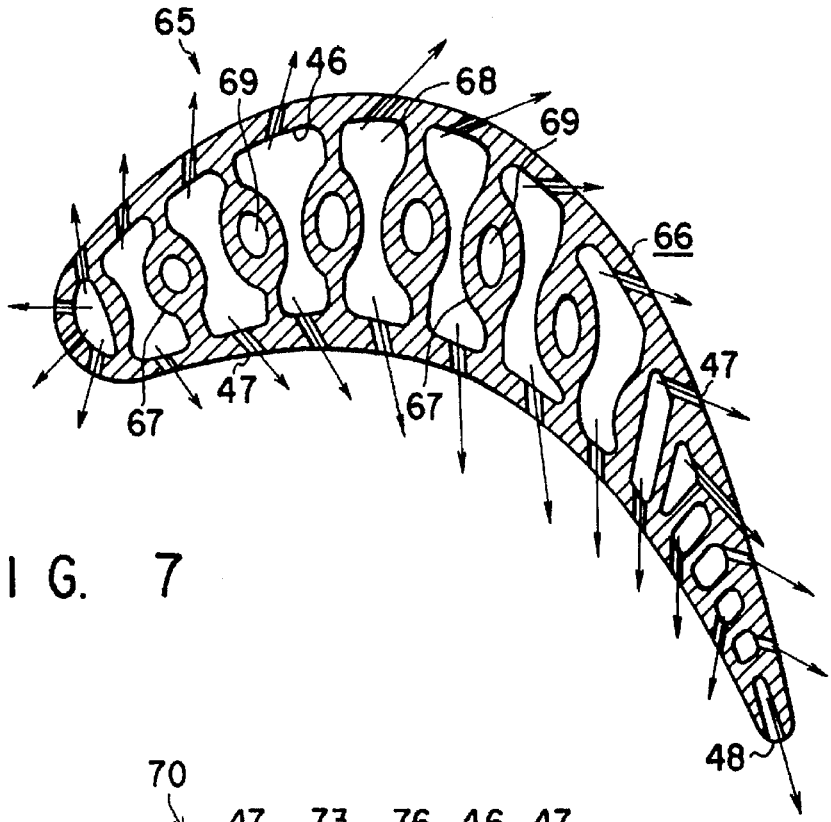
FIG. 7 is a transverse cross-sectional view of a fifth embodiment according to a cooled turbine blade of the present invention.

A fifth embodiment will be described with reference to FIG. 7, which is a transverse cross-sectional view thereof. As shown in FIG. 7, a cooled turbine blade 65 has an effective blade portion 66 whose interior is divided into a great number of cooling flow passages 68 by partition walls 67 extending in the span direction.

In the central portion of the partition wall 67 is formed a cavity 69 opened toward the leading edge side and extending in the span direction. A cooling medium stays in the cavity 69. The cross-sectional area of each cooling flow passage 68 in the span direction is small at its central portion and large at its outer wall sides. The cooling medium supplied from the leading edge portion and jetted out of the film holes 47 performs convection cooling of the cooling flow passage 68.

Similarly to the case of the first embodiment, the partition walls 67 are formed so that the ratio of the total heat transmission area facing cooling flow passages 68 to the total heat transmission area of the inner surface of the outer wall 46 of the turbine blade including the thickness of the portions of the partition walls 67 fixed to the inner surface of the outer wall 46 is 1.5 or more.

This embodiment exhibits the similar function and effect to the first embodiment. Since each partition wall 67 is made apparently thick by provision of the cavity 69, the thermal stresses are prevented from being concentrated and the turbine blade can be made light in weight.

Figure 8:
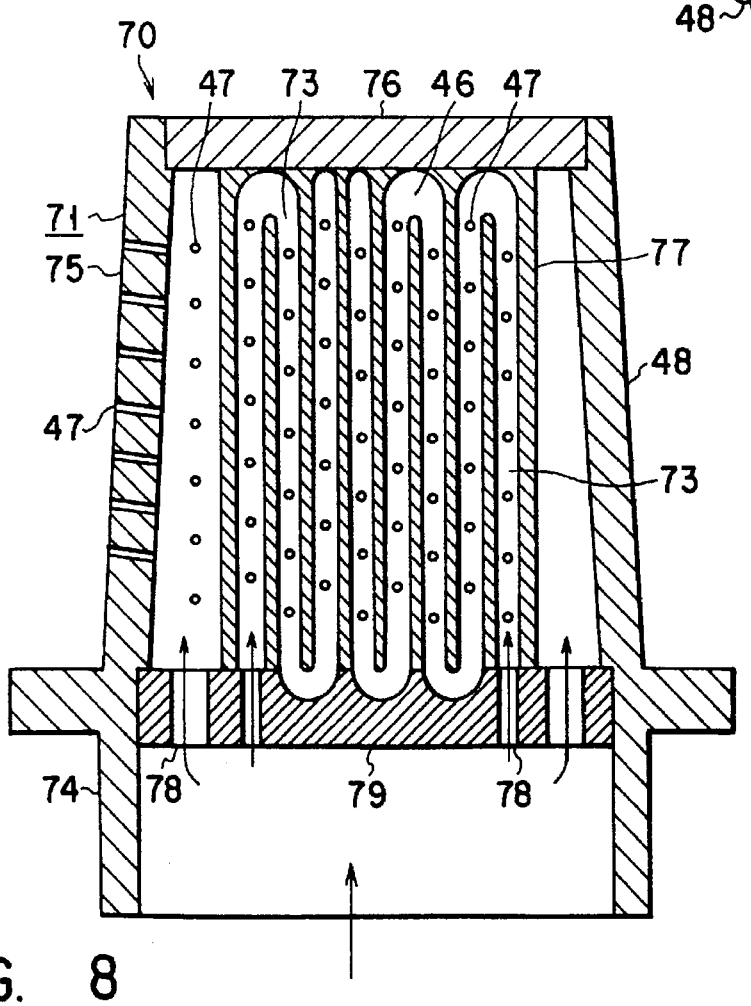
FIG. 8 is a longitudinal cross-sectional view of a sixth embodiment according to a cooled turbine blade of the present invention.

A sixth embodiment will described with reference to FIG. 8 which is a longitudinal cross-sectional view thereof. As shown in FIG. 8, a cooled turbine blade 70 has an effective blade portion 71 whose interior is divided into a great number of cooling flow passages 73 forming return flow passages by partition walls 72 extending in the span direction. A great number of film holes 72 are formed in the outer wall of the turbine blade.

Similarly to the case of the first embodiment, the partition walls 72 are formed so that the ratio of the total heat transmission area facing cooling flow passages 73 to the total heat transmission area of the inner surface of the outer wall 46 of the turbine blade including the thickness of the portions of the partition walls 72 fixed to the inner surface of the outer wall 46 is 1.5 or more.

The cooled turbine blade 70 is manufactured in the following way. The leading edge portion of the wing-shaped cylindrical blade body 75 forming the effective blade portion 71 and a root portion 74 is closed by a leading end member 76. An internal main body member 77 divided by partition walls and defining cooling flow passages 73 is placed in the turbine blade from the side of the root portion 74. Then, an insert 79 formed with supplying ports 78 for the cooling medium is inserted in the turbine blade from the side of the root portion 74 and fixed to the turbine blade to close the root portion of the blade body 75.

The turbine blade 70 is convection cooled by the cooling medium supplied from the supplying ports 78 of the root portion 74 to the cooling flow passages 73 and jetted out of the film holes 47.

This embodiment exhibits the similar function and effect to those of the first embodiment.

Figure 9:
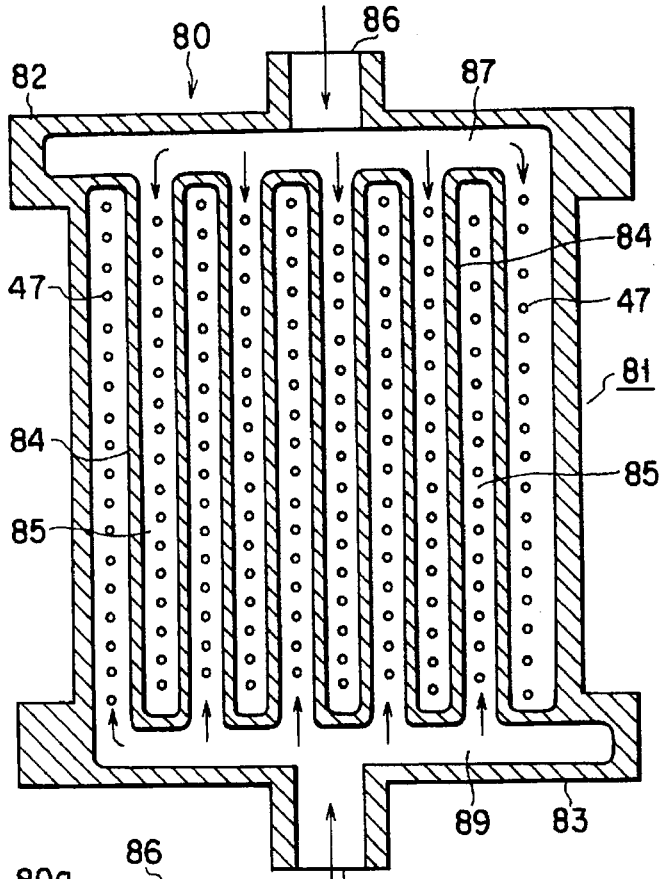
FIG. 9 is a longitudinal cross-sectional view of a seventh embodiment according to a cooled turbine blade of the present invention.
Figure 10:
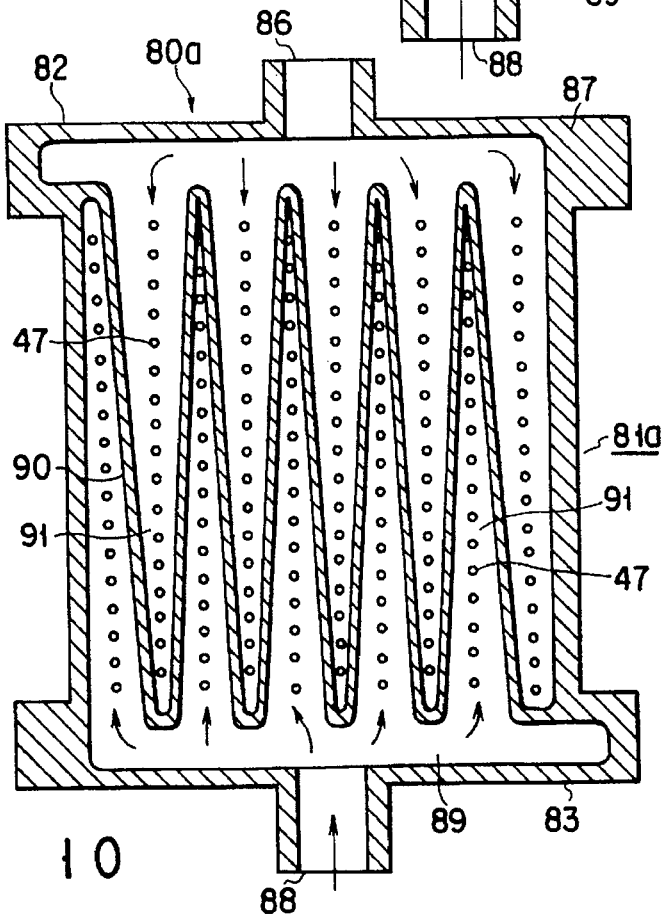
FIG. 10 is a longitudinal cross-sectional view of a modification from the cooled turbine blade according to the seventh embodiment of the present invention.

A seventh embodiment will be described with reference to FIGS. 9 and 10. FIG. 9 is a longitudinal cross-sectional view of this embodiment, and FIG. 10 is a longitudinal cross-sectional view of a modification from this embodiment.

In FIG. 9, a cooled turbine blade 80 of a stator blade type comprises an upper shroud 82, a lower shroud 83 and an effective blade portion 81 formed between both shrouds 82 and 83. The interior of the effective portion 81 is divided into a great number of cooling flow passages 85 having a great number of film holes 47 formed in the outer wall by partition walls 84 extending in the span direction.

The cooling medium is supplied from a cooling medium supplying port 86 of the upper shroud 82 and from a cooling medium supplying port 88 of the lower shroud 83 to the cooling flow passages 85 through spaces 87 and through spaces 89, respectively. The cooling medium supplied to the cooling flow passages 85 flows out through the film fins 47 to perform convection cooling.

Similarly to the case of the first embodiment, the partition walls 84 are formed so that the ratio of the total heat transmission rear facing cooling flow passages 85 to the total heat transmission area of the inner surface of the outer wall 46 of the turbine blade including the thickness of the portions of the partition walls 84 fixed to the inner surface of the outer wall 46 is 1.5 or more.

This embodiment exhibits the similar function and effect to those of the first embodiment.

In the case of FIG. 9, the cross-sectional area of each cooling flow passage 85 is constant. As shown in FIG. 10, however, the cross-sectional area of each cooling flow passage 91 divided by the corresponding partition wall 90 in a cooled turbine blade 80*a* can be made gradually smaller from the upper shroud 82 toward the lower shroud 83. In this case, the ratio of the total heat transmission area facing cooling flow passages 91 to the total heat transmission area of the inner surface of the outer wall 46 of the turbine blade including the thickness of the portions of the partition walls 90 fixed to the inner surface of the outer wall 46 is also made 1.5 or more.

Since the cross-sectional area of each cooling flow passage 91 divided is gradually smaller along the flow of the cooling medium in this modification, reduction of the flow rate of the cooling medium in the turbine blade is suppressed even if the flow rate of the cooling medium is reduced by the jetting-out of the cooling medium from the outer wall so as to perform film cooling or the like. Thus, sufficient convection cooing effect is provided over the wide range of the cooling flow passages.

Figure 11:
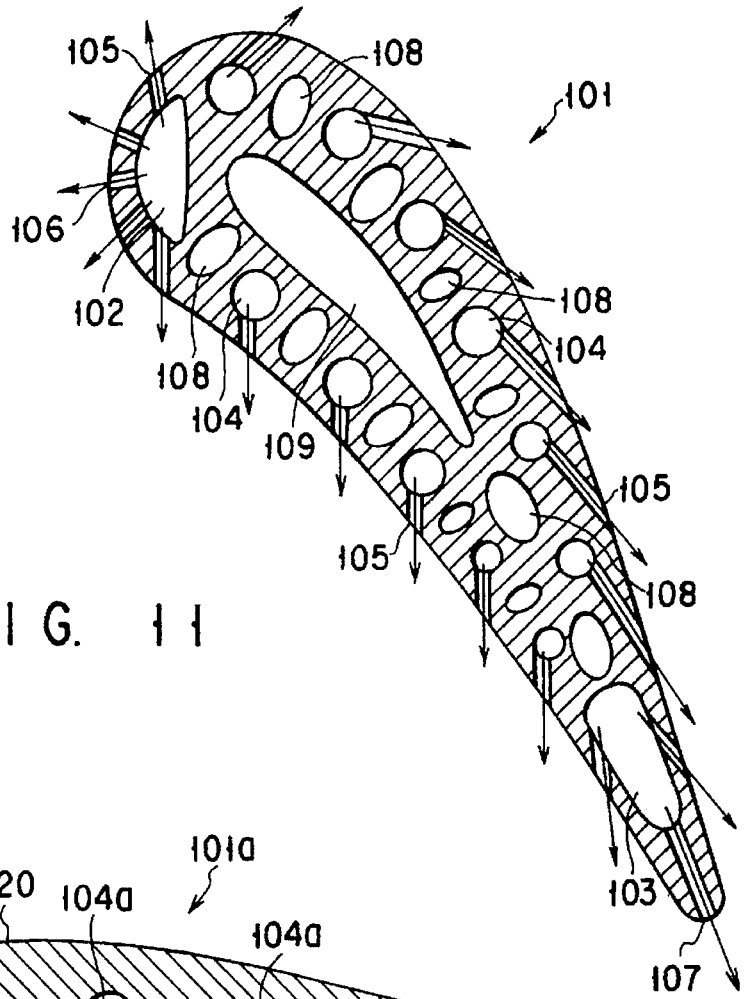
FIG. 11 is a transverse cross-sectional view of an eighth embodiment according to a cooled turbine blade of the present invention.

An eighth embodiment of the present invention will described with reference to FIGS. 11 to 19. FIG. 11 is a transverse cross-sectional view thereof. FIGS. 12 to 19 are enlarged transverse cross-sectional views of the main parts of modifications.

As shown in FIG. 11, a plurality of main cooling flow passages 102, 103 and 104 for supplying a cooling medium are arranged substantially periodically along the outer wall in a cooled turbine blade 101. The cooling medium flows through the main flow passages to perform convention cooling and is jetted out of film holes 105 and 106 to the outer surfaces of the turbine blade to perform film cooling. The cooling medium is jetted out of the main cooling flow passage 103 in the trailing edge portion through jet holes 107.

Between the main flow passages 102 and 104 and 103 and 104 in the cooled turbine blade 101 are formed a plurality of parallel secondary cooling flow passages 108 and 109 through which the cooling medium flows at a flow rate smaller than that through the main cooling flow passages 102, 103 and 104, or in which the cooling medium stays or through which the cooling medium does not flow but in which the cooling medium is filled and stays.

This arrangement can provide a cooled turbine blade 101 in which the blade temperature distribution is uniform and the cooling efficiency is large. The deformation produced in the vicinity of the outer surface of the cooled turbine blade 101 is absorbed by the secondary cooling flow passages 108 and 109 functioning as spaces, whereby generation of large thermal stresses can be suppressed. The cooled turbine blade of this embodiment has a relatively simple internal structure and can be manufactured well by the conventional method.

As many secondary cooling flow passages 108 and 109 are formed, the mass of the effective blade portion can be decreased and thus the centrifugal stresses due to rotation can be lowered when these cooling flow passages are used in a rotor blade, for example.

Figure 12:
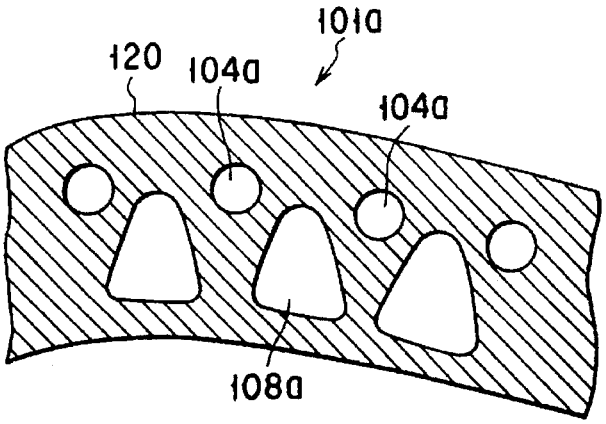
FIG. 12 is an enlarged transverse cross-sectional view of part of a first modification from the cooled turbine blade according to the eighth embodiment of the present invention.
Figure 13:
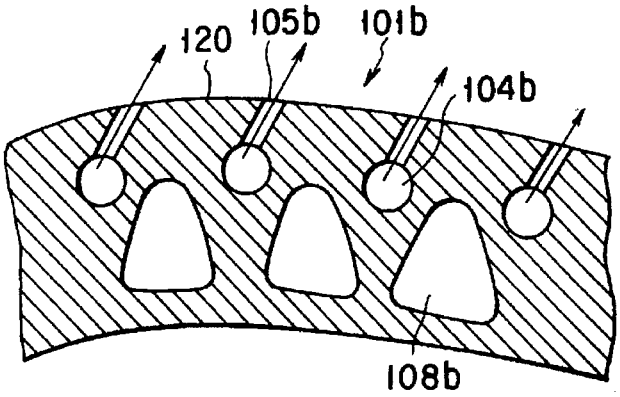
FIG. 13 is an enlarged transverse cross-sectional view of part of a second modification from the cooled turbine blade according to the eighth embodiment of the present invention.

In place of the secondary cooling flow passages in FIG. 11, secondary cooling flow passages 108*a* may be formed in a cooled turbine blade 101*a* according to a first modification from this embodiment as shown in FIG. 12. The secondary cooling flow passages 108*a* each having a substantially triangular cross section with its apex directed toward the blade surface 120 are formed in the cooled turbine blade 101*a* between main cooling flow passages 104*a* having no film holes and a circular cross section. Alternatively, secondary cooling flow passages 108*b* may be formed in a cooled turbine blade 101*b* according to a second modification from this embodiment as shown in FIG. 13. The secondary cooling flow passages 108*b* each having a substantially triangular cross section with its apex directed toward the blade surface 120 are formed in the cooled turbine blade 101*b* between main cooling flow passages 104*b* having film holes and a circular cross section.

Figure 14:
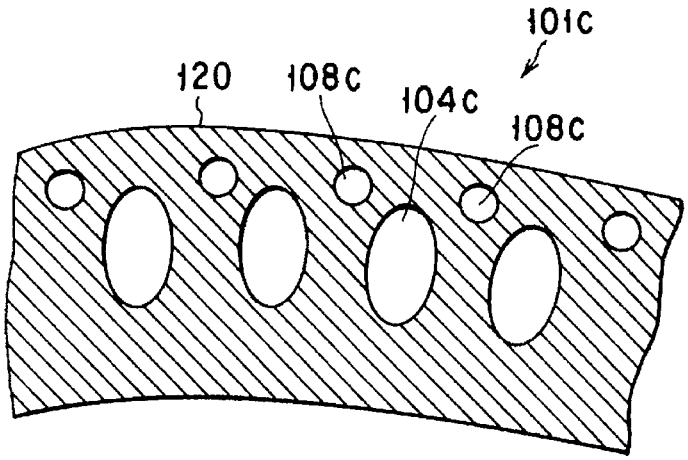
FIG. 14 is an enlarged transverse cross-sectional view of part of a third modification from the cooled turbine blade according to the eighth embodiment of the present invention.
Figure 15:
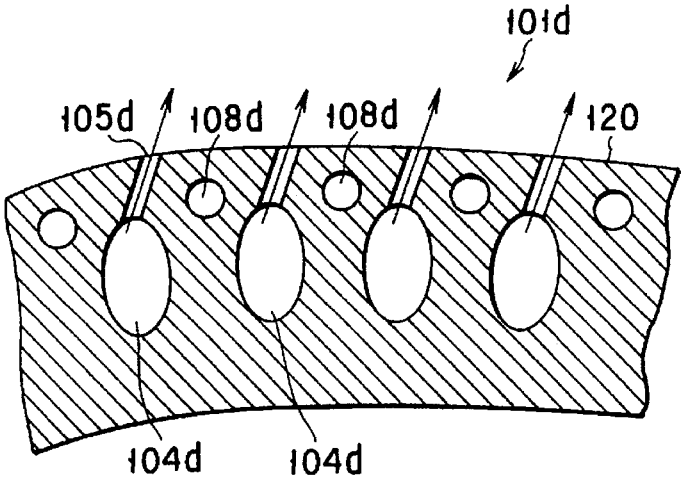
FIG. 15 is an enlarged transverse cross-sectional view of part of a fourth modification from the cooled turbine blade according to the eighth embodiment of the present invention.

Secondary cooling flow passages 108*c* may be formed in a cooled turbine blade 101*c* according to a third modification from this embodiment as shown in FIG. 14. The secondary cooling flow passages 108*c* each having a circular cross section are formed in the cooled turbine blade 101*a* between main cooling flow passages 104*a* having no film holes and an elliptical cross section. Alternatively, secondary cooling flow passages 108*d* may be formed in a cooled turbine blade 101*d* according to a fourth modification from this embodiment as shown in FIG. 15. The secondary cooling flow passages 108*b* each having a circular cross section are formed in the cooled turbine blade 101*b* between main cooling flow passages 104*b* having film holes and an elliptical cross section.

Figure 16:
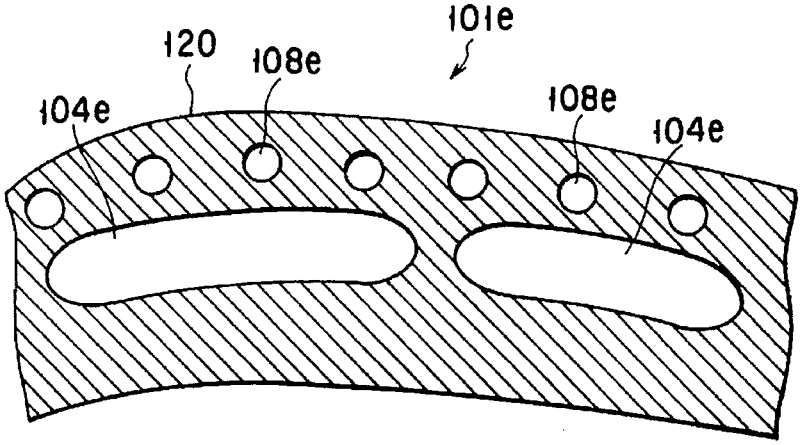
FIG. 16 is an enlarged transverse cross-sectional view of part of a fifth modification from the cooled turbine blade according to the eighth embodiment of the present invention.
Figure 17:
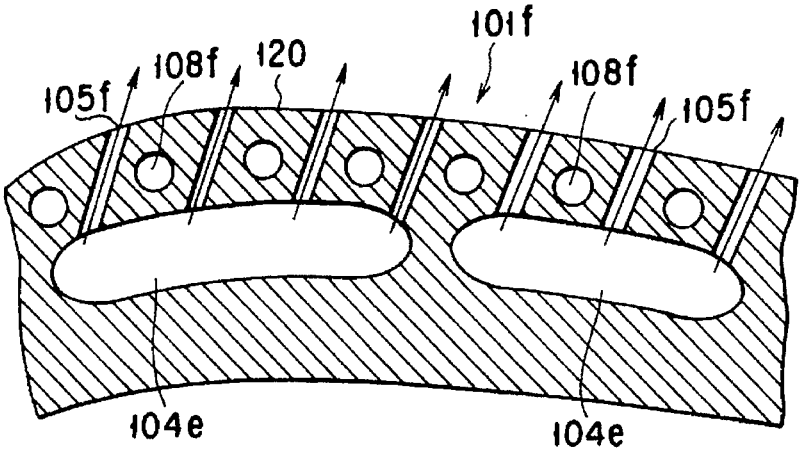
FIG. 17 is an enlarged transverse cross-sectional view of part of a sixth modification from the cooled turbine blade according to the eighth embodiment of the present invention.
Figure 18:
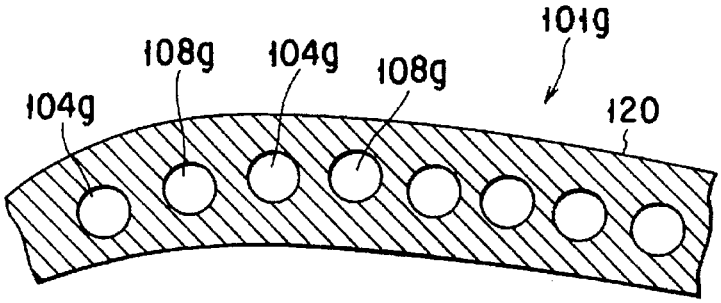
FIG. 18 is an enlarged transverse cross-sectional view of part of a seventh modification from the cooled turbine blade according to the eighth embodiment of the present invention.

Secondary cooling flow passages 108*e* may be formed in a cooled turbine blade 101*e* according to a fifth modification from this embodiment as shown in FIG. 16. Main cooling flow passages 104*e* having no film holes and an elliptical cross section are formed in the cooled turbine blade 101*e* with their major axes extending along the blade surface 120.

The secondary cooling flow passages 108*e* each having a circular cross section are formed between main cooling flow passages 104*e* in the cooled turbine blade 101*e*. Alternatively, secondary cooling flow passages 108*f* may be formed in a cooled turbine blade 101*f* according to a sixth modification from this embodiment as shown in FIG. 16. Main cooling flow passages 104*e* having film holes and an elliptical cross section are formed in the cooled turbine blade 101*e* with their major axes extending along the blade surface 120. The secondary cooling flow passages 108*f* each having a circular cross section are formed between main cooling flow passages 104*b* in the cooled turbine blade 101*f*.

Figure 19:
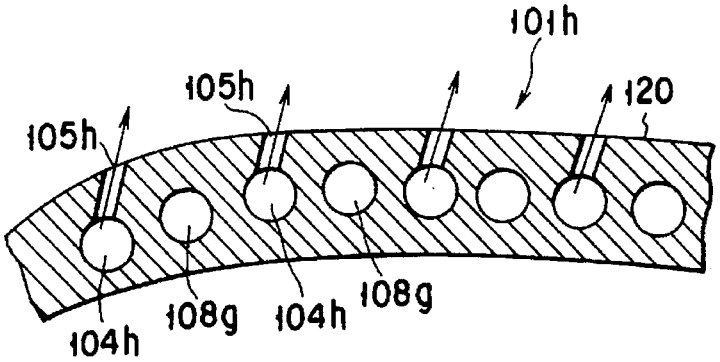
FIG. 19 is an enlarged transverse cross-sectional view of part of an eighth modification from the cooled turbine blade according to the eighth embodiment of the present invention.

Secondary cooling flow passages 108*g* may be formed in a cooled turbine blade 101*g* according to a seventh modification from this embodiment as shown in FIG. 19. Main cooling flow passages 104*g* formed in the cooled turbine blade 101*g* have no film holes and a circular cross section. The secondary cooling flow passages 108*g* each having a circular cross section substantially equal to the circular cross section of the main cooling flow passages 104*g* are formed between main cooling flow passages 104*g* in the cooled turbine blade 101*g*. Alternatively, secondary cooling flow passages 108*h* may be formed in a cooled turbine blade 101*h* according to an eighth modification from this embodiment as shown in FIG. 19. Main cooling flow passages 104*h* formed in the cooled turbine blade 101*h* have film holes and a circular cross section. The secondary cooling flow passages 108*h* each having a circular cross section substantially equal to the circular cross section of the main cooling flow passages 104*h* are formed between main cooling flow passages 104*h* in the cooled turbine blade 101*h*.

Figure 20:
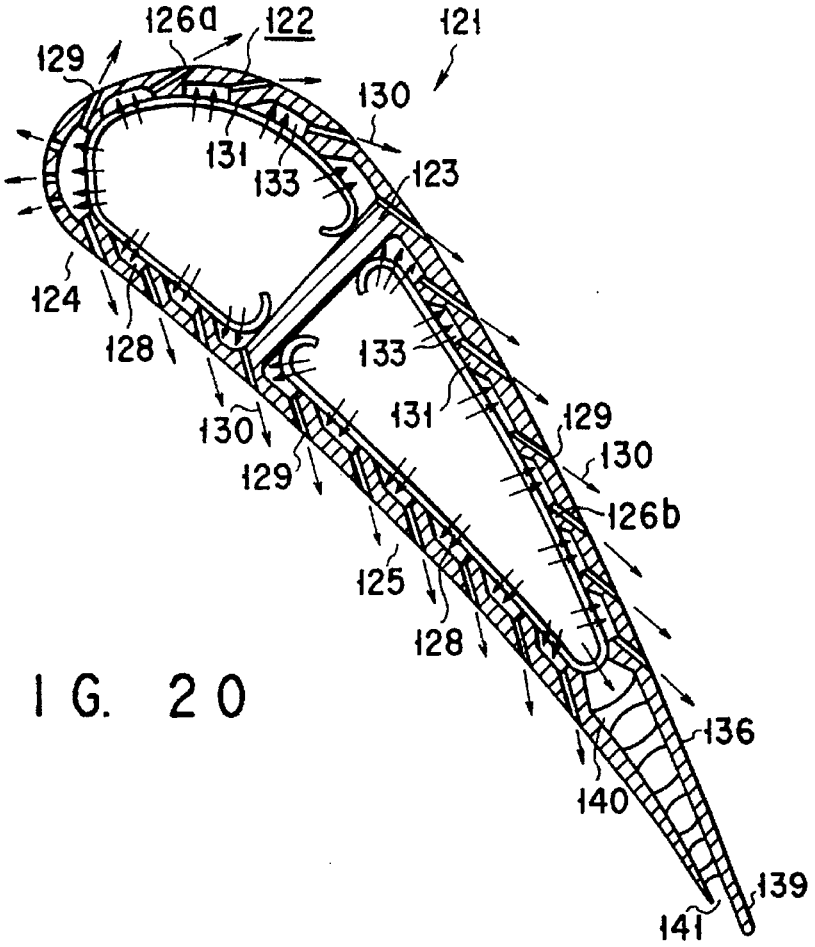
FIG. 20 is a transverse cross-sectional view of the central portion of a ninth embodiment according to a cooled turbine blade of the present invention.
Figure 21:
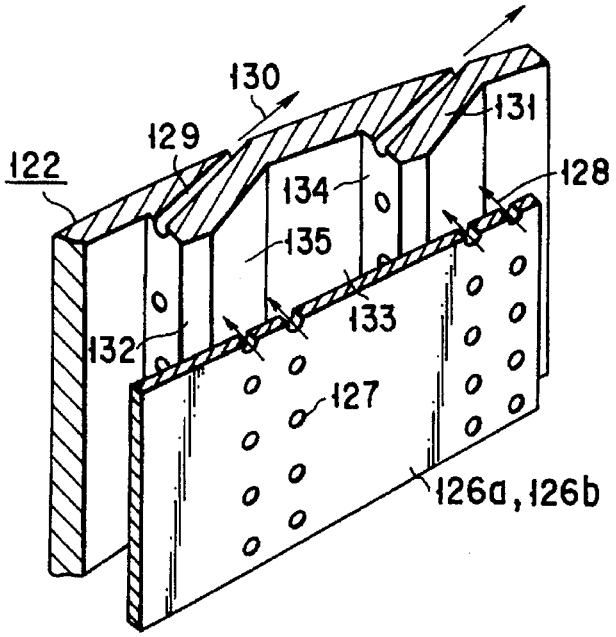
FIG. 21 is an enlarged transverse cross-sectional view of part of the cooled turbine blade according to the ninth embodiment of the present invention.

A ninth embodiment of the present invention will be described with reference to FIGS. 20 to 27. FIG. 20 is a transverse cross-sectional view thereof, and FIG. 21 is an enlarged perspective view of a part thereof. FIGS. 22 to 27 are enlarged perspective views of parts of modifications from this embodiment.

As shown in FIGS. 20 and 21, a cooled turbine blade 121 has a hollow blade body 122 whose interior is divided into a leading edge portion 124 and a trailing edge portion 125 by a partition wall 123. Inserts 126*a* and 126*b* for impingement cooling are provided in the edge portions 124 and 125 so as to be spaced by predetermined distances from the inner surface of the outer wall of the turbine blade.

Impinge cooling 128 of the hollow blade body 122 is performed from the inside of the main body 122 by the cooling medium supplied to the interior of the inserts 126*a* and 126*b* through small holes 127 formed in the inserts 126*a* and 126*b*. At the same time, the temperature of the material of the turbine blade is held to a value lower than the critical temperature by using, together with impingement cooling, so-called film cooling in which the cooling medium such as a cooling gas is jetted out through rows of small holes 129 penetrating the outer wall of the turbine blade and the outer surface of the turbine blade is covered with a film of the cooling medium at a temperature lower than that of the burnt gas. Further, the thermal stresses generated in the turbine blade is reduced.

In order to house the inserts 126*a* and 126*b* in a state in which they are spaced by a predetermined distance from the inner surface of the outer wall of the turbine blade, a great number of holding walls 131 projecting toward the inside of the blade height direction and having a trapezoidal cross section with an upstream side face 134 perpendicular to the inner wall of the outer wall of the turbine blade (a perpendicular face) and with an inclined downstream side face (inclined face) 135. The top flat surfaces 132 of the holding walls 131 press the facing surfaces of the inserts 126*a* and 126*b* to hold the same. Provision of many partition chambers 133 between the adjacent holding walls 131 allows for reduction of communication between the adjacent partition chambers 133.

The cooling medium flowing into the partition chambers 133 through the small holes 127 performs impingement cooling 128 of the inner surface of the hollow blade body 122 corresponding to the respective partition chambers 133 and is jetted out of the turbine blade through the small holes (film holes) 129 provided in the partition chambers 133. It is known that the cooling effect of the film cooling 130 is improved as the jetting direction of the cooling medium becomes parallel with the outer surface of the blade body. In this embodiment, the film holes 120 incline at a small angle with respect to the outer surface of the blade body so that the cooling medium flows out of the blade body at this small angle toward the downstream side of the flow of the cooling medium.

Each film hole 129 extends through the corresponding holding wall 131 and opens at the perpendicular face of the holding wall 131 and the outer surface of the blade body so that the internal convection surface area of the film hole 129 becomes large. Thus, the cooling medium flowing through the film hole 129 has a high convection cooling ability. The cooling medium flowing in each partition chamber 133 for impingement cooling 128 through the small holes 127 impinges on the inclined face 135 and is reflected toward the perpendicular face 134. Thus, the cooling medium is supplied to the film hole 129 efficiently.

The static pressure distribution of the blade surface and the heat transmission distribution greatly affecting the jetting-out of the cooling medium for film cooling 130 mainly change along the direction of the blade surface. In the turbine blade having the partition chambers 133 divided along the blade surface in the lower portion of the hollow blade body 122 of this embodiment, therefore, the distribution of the cooling medium jetted out of the partition chambers 133 for film cooling 130 can be finely controlled, resulting in high cooling ability and effective usage of the cooling medium.

In this embodiment, two inserts 126*a* and 126*b* are provided in the turbine blade, and rows of pin fins 140 for cooling are arranged in a trailing edge portion 136 whose thickness is reduced toward its trailing edge 139. However, rows of turbulence promoters extending in the direction of the blade height or a great number of small holes provided along the blade surface may be arranged in the height direction. In this embodiment, the cooling medium which has made convection in the trailing edge portion is discharged from openings 141 in the trailing edge 139 toward the downstream of the turbine blade.

Figure 22:
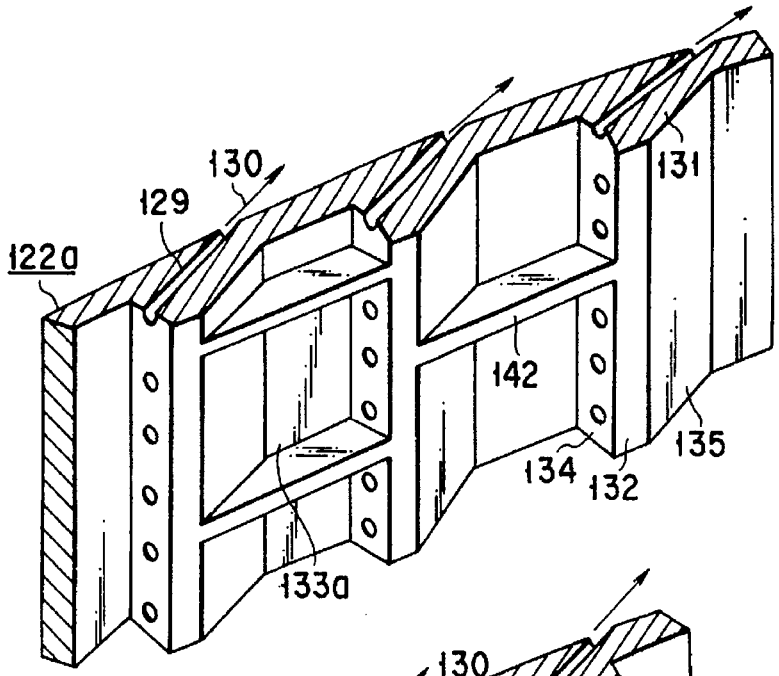
FIG. 22 is an enlarged perspective view of part of a first modification from the cooled turbine according to the ninth embodiment of the present invention.

A modification from this embodiment will be described. FIG. 22 is a perspective view of a first modification in which inserts 126*a* and 126*b* are omitted. Ribs 142 are provided between the adjacent holding walls 131 formed on the inner surface of the hollow blade body 122*a*. Each partition chamber is divided by the ribs 142 into partition chamber portions 133*a* arranged in the blade height direction. Although the static pressure distribution of the blade surface and the heat transmission distribution greatly effecting the jetting-out of the cooling medium for film cooling 130 mainly change along the blade surface, the gas temperature (the temperature of the cooling medium) is distributed at strong distribution of several hundred ° C. in the direction of the blade height. Use of the ribs 142 which actualizes the division in the direction of the blade height further reduces the amount of the cooling medium which can be finely controlled.

It is apparent that the ribs 142 contribute to the improvement of convection cooling effect from the inside of the partition chamber portions 133*a*, because the ribs 142 also function as enlarged heat transmission surfaces (fins) extending from the blade surface to the partition chamber portions 133*a*. The ribs 142 may be provided only at the necessary portions. It is unnecessary to form the ribs 142 at the same blade height but they may be formed in a staggered fashion as shown.

Each partition chamber portion 133*a* has three film holes 129. However, the number of the film holes per partition chamber portion is not always limited to three but may be one when each partition chamber portion is small. Additional film holes 129 (not shown) can be formed in the portions of the blade body 122*a* on which the holding walls 131 do not exist so as to increase the number of the film holes 129. When the interior of the hollow blade body 122*a* is divided into a plurality of partition chamber portions 133*a* for cooling even in such a case, an adverse effect of the cooling ability on the other portions of the turbine blade (the other partition chamber portions) can be minimized. In other words, the cooling ability of one portion of the turbine blade can be improved by increasing the number of film holes 129 merely in this portion.

Figure 23:
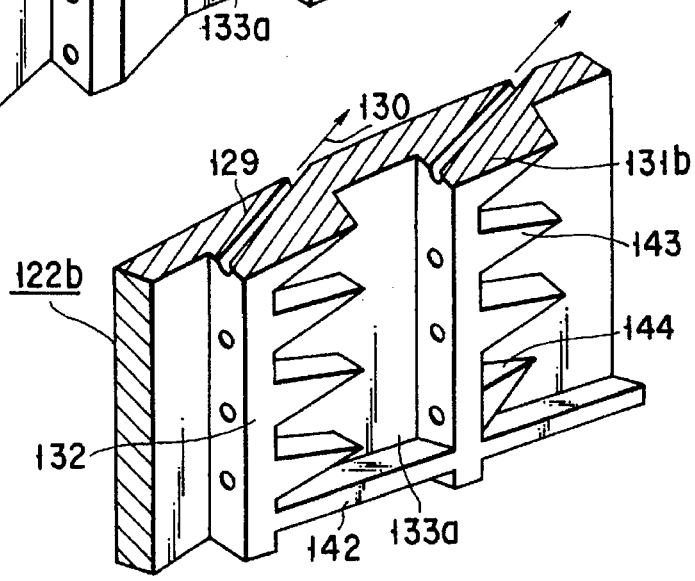
FIG. 23 iS an enlarged perspective view of part of a second modification from the cooled turbine according to the ninth embodiment of the present invention.

FIG. 23 is a perspective view of a second modification from this embodiment, in which inserts 126*a* and 126*b* are omitted. Extending in the direction of the blade height from the inner surface of a hollow blade body 122*b* are great number of holding walls 131*b* whose main portion has a substantially rectangular shape. Each holding wall 131*b* has triangular comb-shaped portions 143 and 144 each extending toward the trailing edge along the blade surface. The height of every portion of each comb-shaped portion 143 is the same as that of the main portion of the holding wall 131*b*, but the height of each comb-shaped portion 144 is made smaller from the main portion of the holding wall 131*b* toward the downstream side.

Film holes 129 are formed in the holding walls 131*b*. In this modification, the portions of the outer wall of the hollow blade body 122*b* which define the partition chamber portions 133*a* are made thin so as to reduce the heat resistance of the turbine blade. As the formation density of the film holes 129 is small, this structure is effective when the impingement cooling effect is high.

The comb-shaped portions 143 and 144 also function as enlarged heat transmission surfaces (fins) of the surface material of the hollow blade portion 122*b*. When impingement cooling holes (not shown) are formed in the portions of the inserts between the comb-shaped portions 143 and 144, the cooling medium impinging on the inner surface of the hollow blade body 122*b* is guided by the comb-shaped portions 143 and 144 and flows rightward in FIG. 23. Then, the cooling medium is jetted out to the outside of the turbine blade after the cooling medium has hit against the main portions of the holding walls 131*b*. It is apparent that both the holding walls 131*b* and the comb-shaped portions 143 and 144 constitute good enlarged heat transmission surfaces.

Figure 24:
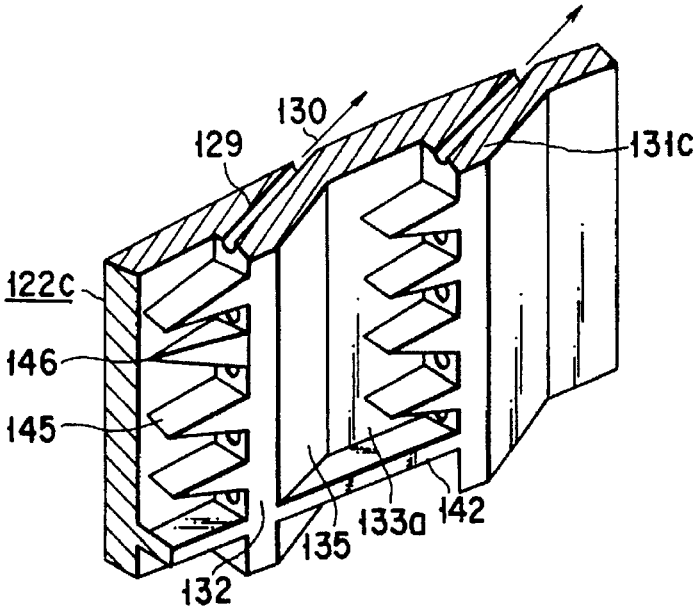
FIG. 24 is an enlarged perspective view of part of a third modification from the cooled turbine according to the ninth embodiment of the present invention.

FIG. 24 is a perspective view of a third modification from this embodiment, in which inserts 126*a* and 126*b* are omitted. Extending in the direction of the blade height from the inner surface of a hollow blade body 122*c* are great number of holding walls 131*c* whose main portion has a substantially trapezoidal shape with an upstream side face perpendicular to the inner surface of the blade body and with an inclined downstream side face. Each holding wall 131*b* has triangular comb-shaped portions 145 and 146 each extending toward the leading edge along the blade surface. The height of every portion of each comb-shaped portion 145 is the same as that of the main portion of the holding wall 131*b*, but the height of each comb-shaped portion 146 is made smaller from the main portion of the holding wall 131*b* toward the upstream side.

Film holes 129 are formed in each holding wall 131*c* and open at portions between the comb-shaped portions 145 and 146. This arrangement securely introduces the cooling medium in the film holes 129 and gives a fin effect to the just upstream portion of the film holes 129 whose cooling efficiency is relatively lowered by the accelerated cooling medium introduced into the film holes 129 at a high speed in order to cool the upstream portion.

Figure 25:
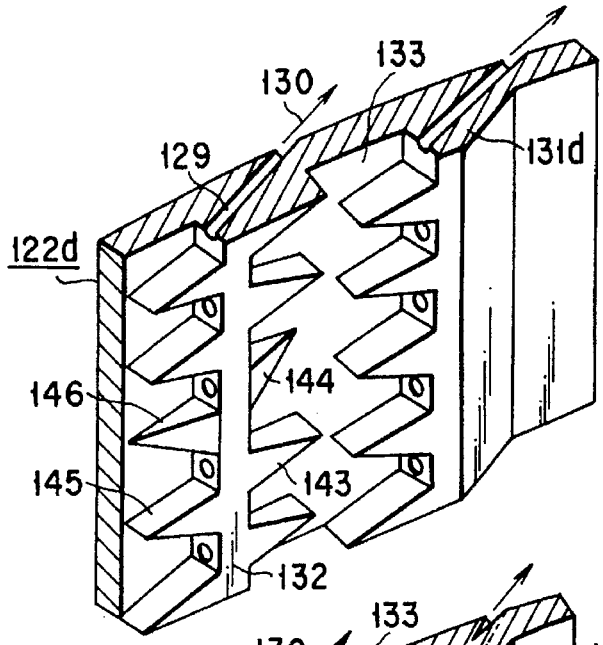
FIG. 25 is an enlarged perspective view of part of a fourth modification from the cooled turbine according to the ninth embodiment of the present invention.

FIG. 25 is a perspective view of a fourth modification from this embodiment, in which inserts 126*a* and 126*b* are omitted. Extending in the direction of the blade height from the inner surface of a hollow blade body 122*d* are great number of holding walls 131*d* whose main portion has a substantially rectangular shape. Each holding wall 131*d* has triangular comb-shaped portions 145 and 146 each extending toward the trailing edge along the blade surface.

This modification exhibits the same effect as the second and third embodiments.

Figure 26:
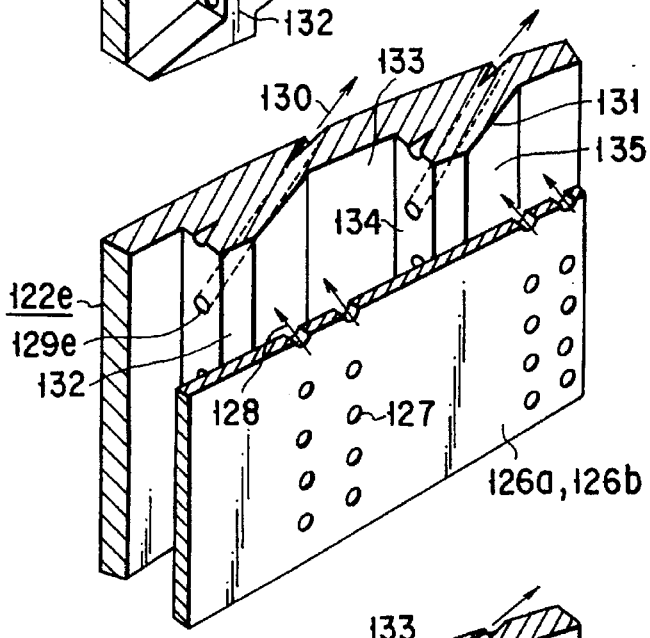
FIG. 26 is an enlarged perspective view of part of a fifth modification from the cooled turbine according to the ninth embodiment of the present invention.

FIG. 26 is a perspective view of a fifth modification from this embodiment. An inclined film hole 129 extends in the span direction through each holding wall 131 formed on the inner surface of a hollow blade body 122*e* and opens at a side face 134 substantially perpendicular to the inner surface of the blade body and at the outer surface of the blade body.

In the cooled turbine blade having a great number of film holes 129*e*, represented by an FCFC turbine blade, the inner surface area of the film holes 129*e* increases. Thus, convection cooling effect is enhanced and high cooling ability is actualized. The inner heat transmission surface area increases by about 40% by inclining the film holes 129*e* by 45° from the direction of blade height with the result that the cooling ability of the just upstream portions of the film holes 129*e* at which the film cooling effect is relatively low.

Figure 27:
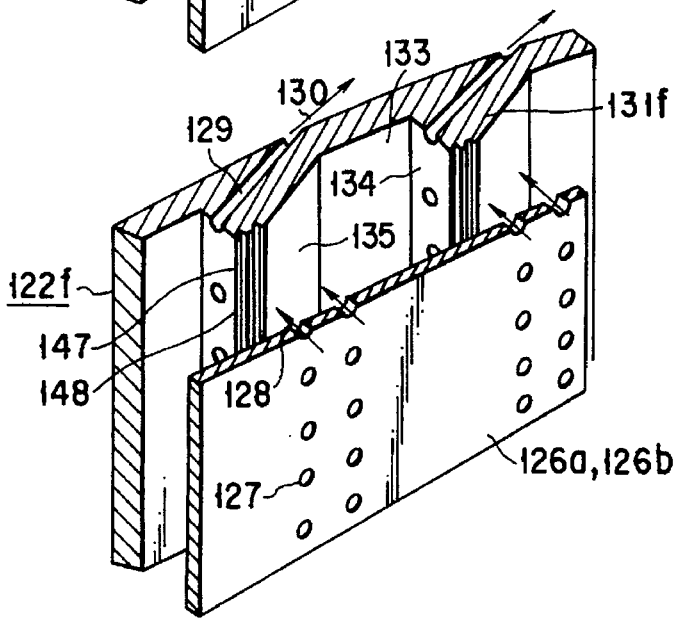
FIG. 27 is an enlarged perspective view of part of a sixth modification from the cooled turbine according to the ninth embodiment of the present invention.

FIG. 27 is a perspective view of a sixth modification from this embodiment. Extending in the direction of the blade height from the inner surface of a hollow blade body 122*f* are great number of holding walls 131*f* whose main portion has a substantially trapezoidal shape with an upstream side face perpendicular to the inner surface of the blade body and with an inclined downstream side face. A great number of sealing depressions 148 such as fine grooves or cavities are formed in the top surface 147 of each holding wall 131*f* and extend in the direction in which the top surface extends. The top surfaces 147 are pressed against the facing surfaces of inserts 126*a* and 126*b* and hold them. Many partition chambers 133 are formed between the adjacent holding walls 131*f*. The sealing effect between the adjacent partition chambers 133 is improved so as to reduce the amount of flow of the cooling medium.

Formation of the sealing depressions 148 prevents the cooling medium from leaking through very small spaces between the holding walls 131*f* and the inserts 126*a* and 126*b*. The sealing depressions 148 are fine and formed perpendicularly to the leak flow and increases the pressure loss to suppress occurrence of the leak flow.

Figure 28:
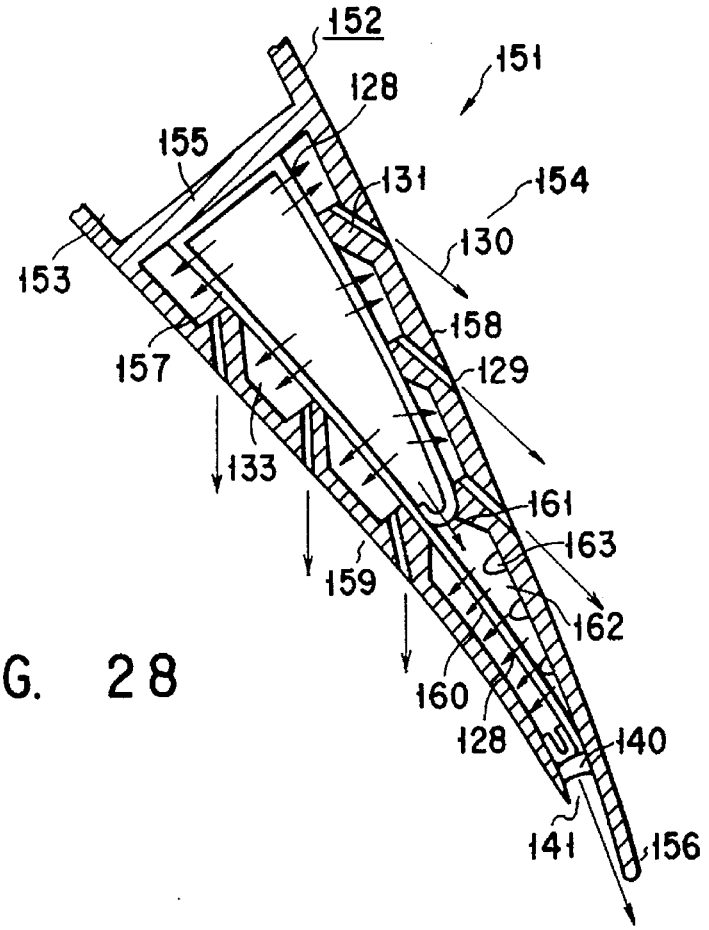
FIG. 28 is a transverse cross-sectional view of the main part of a tenth embodiment according to a cooled turbine body of the present invention.

A tenth embodiment of the present invention will be described with reference to FIG. 28 which is a transverse cross-sectional view of the main part thereof. As shown in FIG. 28, a cooled turbine blade 151 has a hollow blade body 152 comprising a leading edge portion (not shown) and an intermediate portion 153. Like the ninth embodiment, inserts for impingement cooling are housed in the leading edge portion and the intermediate portion 153 in order to perform both impingement cooling and film cooling.

A trailing edge portion 154 is isolated from the intermediate portion 153 by a partition wall 155. In the isolated trailing edge portion 153 is formed a hollow portion whose thickness is reduced toward the trailing edge 156. A great number of holding walls 131 extending in the direction of the blade height are formed on the inner surface of the blade body. An insert 157 is supported by the holding walls 131 in the hollow portion in a state in which the insert 157 is spaced by predetermined distances from the inner surface of the blade body. Partition walls 133 are defined between the adjacent holding walls 131.

The cooling medium is supplied from the leading edge portion to the insert 157. Part of the cooling medium in the insert 157 flows out through small holes (not shown) formed in the part of the insert 157 which is at the thicker leading edge side portion of the trailing edge portion 154 of the hollow blade portion 152. Then, the cooling medium performs impingement cooling 128 of the leading edge side portion. Then, the cooling medium passes through rows of small holes 129 penetrating the outer blade wall and perform film cooling 130.

The pressure side portion of the insert 157 has an extended portion 160 extending toward the trailing edge. The suction side portion of the insert 157 extends to an intermediate part of the trailing edge portion 154. Another part of the cooling medium in the insert 157 flows into an impingement flow passage 162 defined between the inner surface of the rear part of the trailing edge portion 154 and the extended portion 160 of the insert 157 through an opening 161 defined between the suction side free rear end of the insert 157 and the boundary of the pressure side portion and the extended portion 160 of the insert 157. Thereafter, the cooling medium in the flow passage 162 flows out through small holes (not shown) formed in the extended portion 160 and performs impingement cooling 128. A cross-flow is likely to occur at the pressure side in the impingement flow passage 162. In order to prevent the cross-flow, part of the cooling medium whose film is formed on the extended portion 160 may be jetted out of the film holes 129.

Part or all of the cooling medium supplied to the impingement cooling flow passage 162 is discharged from trailing edge openings or exits 141 toward the downstream side of a wing cascade. In this embodiment, a row of pin fins 140 are provided in the trailing edge to position the insert 157. On the inner surface of the impingement flow passage 162 formed at the suction side in the rear edge portion are formed, for example, projecting turbulence promoters 163 for promoting convection type heat transmission.

As a result, impingement cooling 12 can be performed also in the trailing edge portion 154 of the cooled turbine blade 151, and the cooling effect is improved more.

Figure 29:
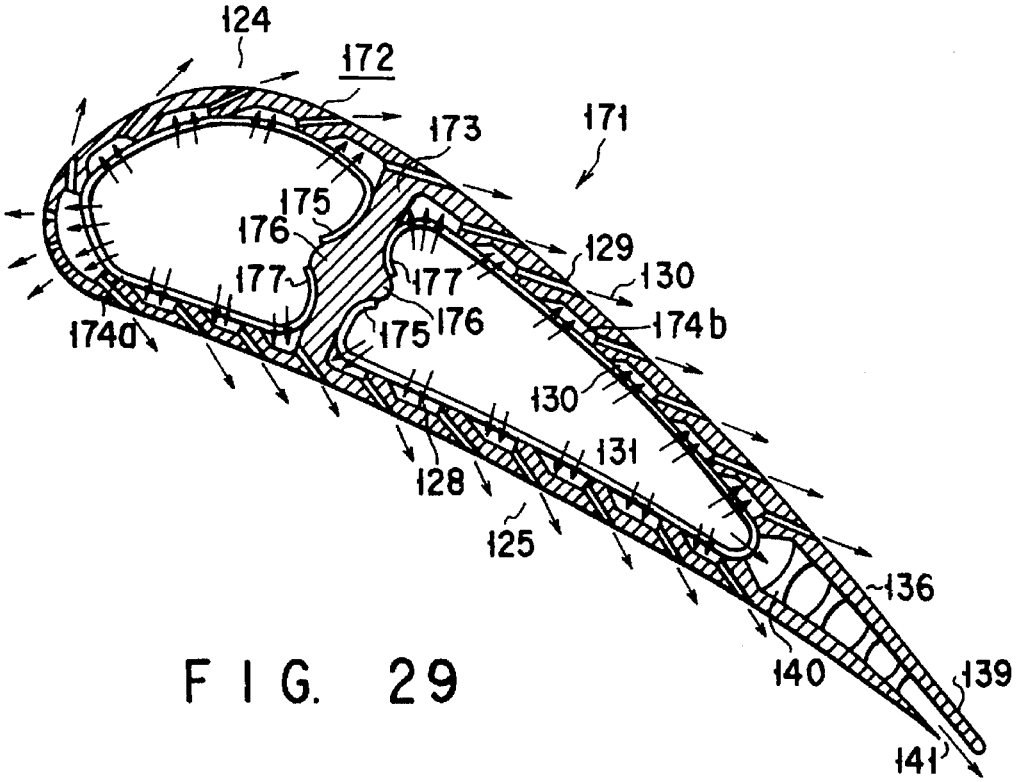
FIG. 29 is a transverse cross-sectional view of the central portion of an eleventh embodiment according to a cooled turbine blade of the present invention.

An eleventh embodiment of the present invention will be described with reference to FIGS. 29 and 30. FIG. 29 is a transverse cross-sectional view of the central portion of a cooled turbine blade, and FIG. 30 is an enlarged perspective view of the main part thereof.

Figure 30:
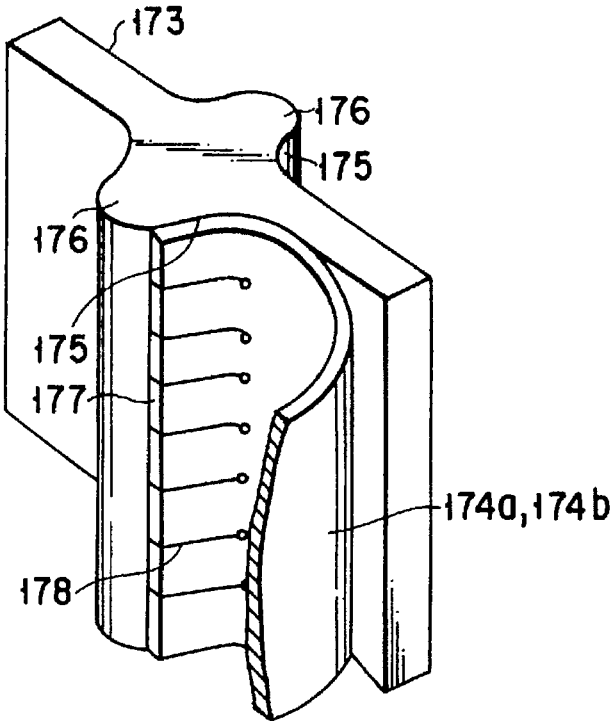
FIG. 30 is an enlarged perspective view of the main part of the cooled turbine blade of the eleventh embodiment of the present invention.
Figure 31:
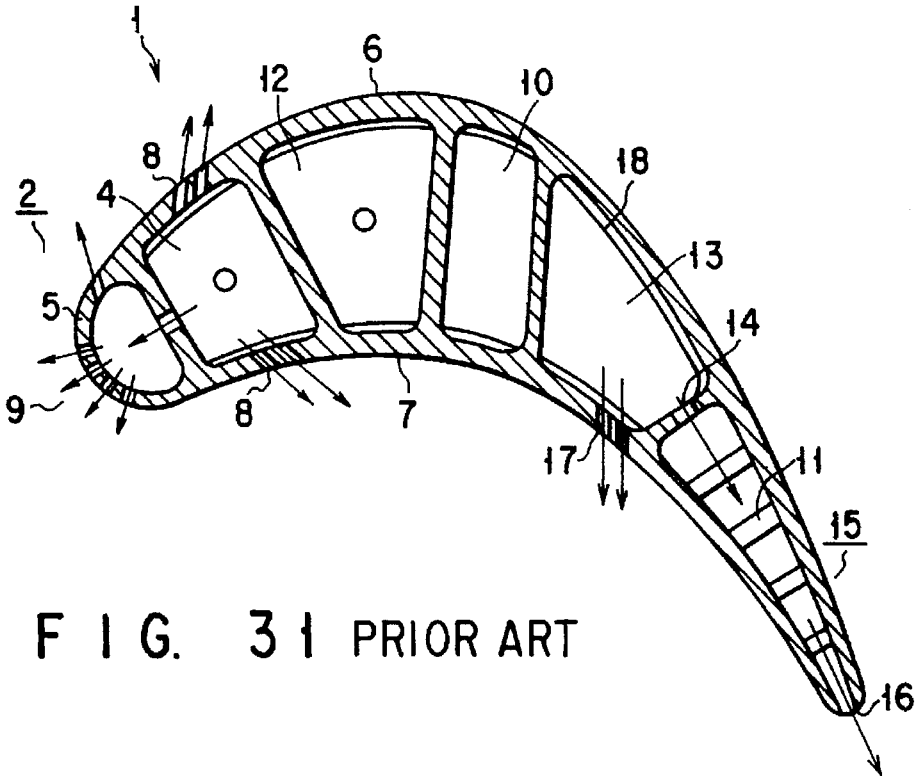
FIG. 31 PRIOR ART
FIG. 31 is a transverse cross-sectional view of a turbine blade of first prior art.
Figure 32:
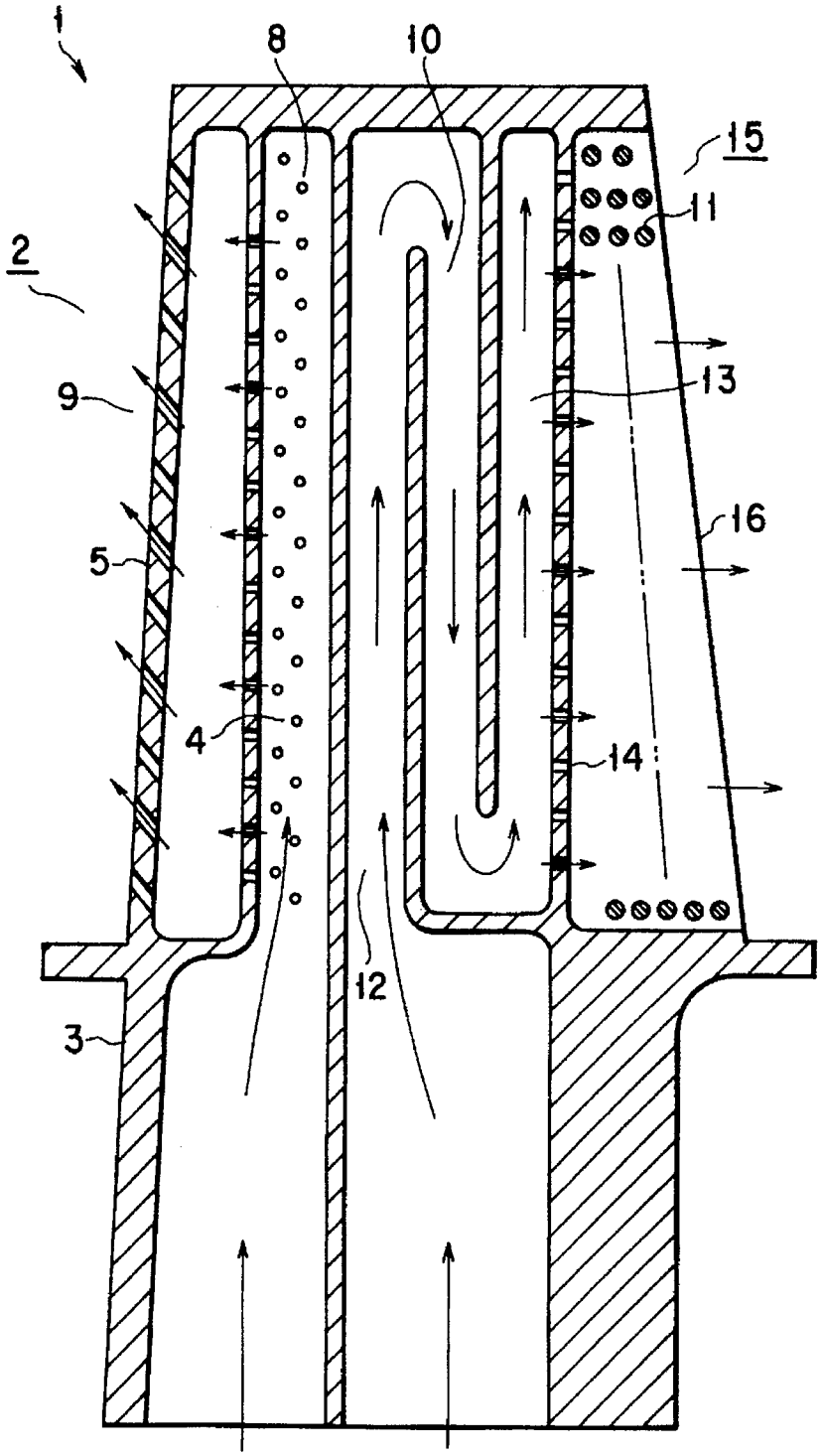
F I G. 32 PRIOR ART
FIG. 32 is a longitudinal cross-sectional view of the first prior art.
Figure 33:
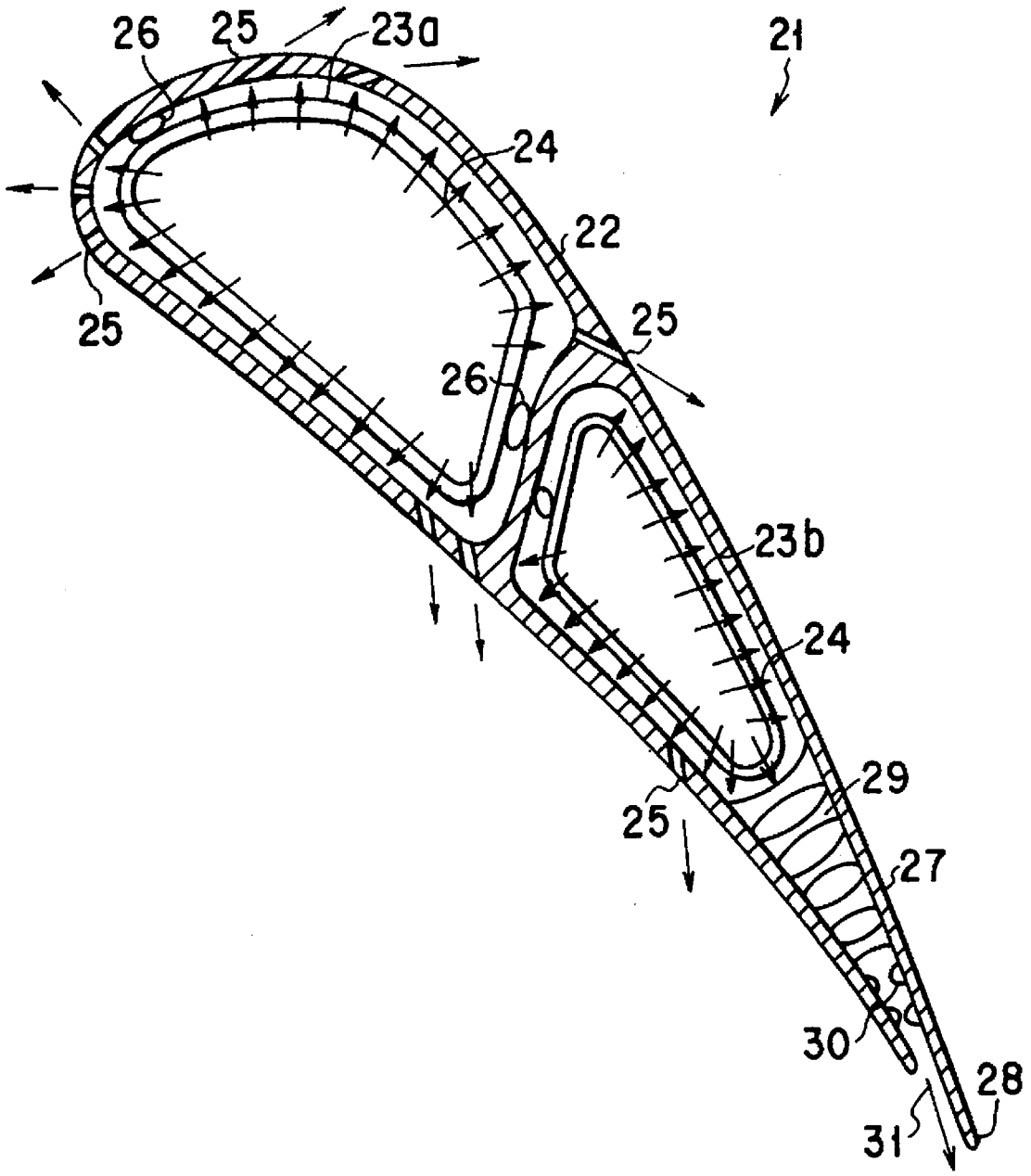
F I G. 33 PRIOR ART
FIG. 33 is a transverse cross-sectional view of a turbine blade of second prior art.

As shown in FIGS. 29 and 30, a cooled turbine blade 171 has a hollow blade body 172 extending in the span direction divided by a partition wall 173 into a leading edge portion 124 and an intermediate portion 175. Inserts **174*a* and 174*b* for impingement cooling are provided in the leading edge portion 124 and the intermediate portion 125 which are spaced by predetermined distances from the inner surface of the blade body. Projections 176 having smooth concave portions 175 extending in the direction of the blade height are formed on the central parts of the leading edge side surface and the trailing edge side surface of the partition wall 173. The tip portions 177 of the insert 174*a* and the insert 174*b* are pressed against the concave portions 175 under their elastic deformation, their restoring forces and the difference between the pressure of the cooling medium in the inserts 174*a* and 174*b* and the pressure in a partition chamber 133 which is lower than the pressure in the inserts 174*a* and 174*b* so as to form a hermetical sealing structure. Even when the cooled turbine blade 171 is operated at the maximum temperature from 800° C. to 900° C., the temperature of the inserts 174*a* and 174*b* is maintained to the temperature close to that of the cooling medium, thereby preventing formation of spaces between the hollow blade body 172 and the inserts 174*a* and 174*b* which are likely to be formed due to the difference of their thermal expansion when the temperature of the inserts 174*a* and 174*b*** is high.

A great number of cuts 178 extending along the blade surface are formed in the tip portions 177 of the inserts **174*a* and 174*b*. When any kind of three-dimensional deformation occurs, short portions of each tip portion 177 follow the deformation because of the cuts 178, and unexpected leak of the cooling medium occurring at the contacting portions of the tip portion 177 and the concave portions 175 is prevented. As a result, the cooling medium can be used effectively. When the hollow blade body 173 is not thermally deformed, sufficient sealing is achieved without forming cuts 178 in the tip portions 177 of the inserts 174*a* and 174*b***.

According to the ninth, tenth and eleventh embodiment of the present invention, film cooling and impingement cooling can be performed without fail and high convection cooling effect can be securely achieved. When, for example, a gas turbine is operated at a high temperature, the blade temperature and the thermal stresses are maintained to low values. Thus, a gas turbine operated at a high temperature by a small amount of a cooling medium can be manufactured. Further, when a system such as a simple cycle or combined cycle electric power plant employs this type of a gas turbine, the heat efficiency of the system is improved.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A cooled turbine blade for a gas turbine which comprises:

an outer wall having an inner surface;

an inner space surrounded by said outer wall;

a hollow insert provided in said inner space;

a plurality of projections formed on the inner surface of said outer wall, having a front side surface and an inclined rear side surface, for supporting said hollow insert, said outer wall being thick at portions where said projections are formed;

a plurality of partition chambers provided between said outer wall and said hollow insert, divided by said projections;

a plurality of impingement holes formed in said insert corresponding to said partition chambers, for jetting out a cooling medium to the inner surface of said outer wall; and a plurality of film cooling holes going through said outer wall, opening on the front side surface of said projections, through which the cooling medium flows from said partition chambers to outside of said outer wall to perform film cooling, and said film cooling holes pierce the thick portions of said outer wall where said projections are formed, and the holes are substantially parallel to the rear side surface.

2. A cooled turbine blade according to claim 1, wherein the front side surface of each of said projections is approximately perpendicular to said inner surface of said outer wall, the rear side surface of each of said projections is diagonally inclined to said inner surface, and the impingement holes of said insert are provided in alignment with said inclined rear side surface of each of said projections, the cooling medium jetted out from the impingement holes being impinged on an inclined rear side surface, the direction of flow of the cooling medium being shifted by said rear side surface, so that the cooling medium flows towards said film cooling holes, which are open at the front side surface of each projection.

3. A cooled turbine blade according to claim 1, wherein rectifying means is provided on the front surface of each of said projections, for guiding the flow of the cooling medium jetted out from said impingement holes, the direction of which was shifted by being impinged on the inner surface of said outer wall, so that the cooling medium is allowed to flow smoothly into each of said film cooling holes, opened to the front surface of each of said projections.

4. A cooled turbine blade according to claim 3, wherein said rectifying means is a comb-shaped portion projecting towards a front between adjacent film cooling holes in the front surfaces of said projections.

5. A cooled turbine blade for a gas turbine which comprises:

an outer wall having an inner surface an inner space surrounded by said outer wall;

a partition wall for dividing said inner space into a leading section and a trailing section;

a hollow insert provided in each section of said inner space;

a plurality of projections formed on the inner surface of said outer wall, having a front side surface and a rear side surface, for supporting said hollow insert, said outer wall being thick at portions where said projections are formed;

a plurality of partition chambers provided between said outer wall and said hollow insert, divided by said projections;

a plurality of impingement holes formed in said insert corresponding to said partition chambers, for jetting out a cooling medium to the inner surface of said outer wall; and a plurality of film cooling holes going through said outer wall, opening on the front side surface of said projections, through which the cooling medium flows from said partition chambers to outside of said outer wall to perform film coolings, and said film cooling holes pierce the thick portions of said outer wall where said projections are formed, and the holes are tilted towards the rear side surface.

6. A cooled turbine blade according to claim 5, wherein said insert is formed by bending an elastic thin plate member into a V-shape or a U-shape, and said insert has two edge portions having edge abutting against said partition wall, said insert expanded by an elastic force thereof and pressed with said projections.

* * * * *